US010774585B2

(12) United States Patent
Foley et al.

(10) Patent No.: US 10,774,585 B2
(45) Date of Patent: Sep. 15, 2020

(54) PERIMETER LIGHT BLOCKOUT SYSTEM

(71) Applicant: Hunter Douglas, Inc., Pearl River, NY (US)

(72) Inventors: Patrick E. Foley, Broomfield, CO (US); Paul Josephson, Broomfield, CO (US); Mark Schwandt, Broomfield, CO (US); Donald J. Clark, Broomfield, CO (US); Wendell B. Colson, Broomfield, CO (US); Paul G. Swiszcz, Broomfield, CO (US); Stephen T. Wisecup, Broomfield, CO (US); Benjamin J. Madden, Broomfield, CO (US); Fred Bould, San Mateo, CA (US); Kwan Hon Anson Cheung, San Mateo, CA (US); Byron Lee, San Mateo, CA (US)

(73) Assignee: HUNTER DOUGLAS INC, Pearl River, NY (US)

( * ) Notice: Subject to any disclaimer, the term of this patent is extended or adjusted under 35 U.S.C. 154(b) by 351 days.

(21) Appl. No.: 15/936,611

(22) Filed: Mar. 27, 2018

(65) Prior Publication Data

US 2018/0283098 A1 Oct. 4, 2018

Related U.S. Application Data

(60) Provisional application No. 62/479,500, filed on Mar. 31, 2017, provisional application No. 62/622,990, filed on Jan. 29, 2018.

(51) Int. Cl.
*E06B 9/58* (2006.01)
*E06B 9/327* (2006.01)
(Continued)

(52) U.S. Cl.
CPC ..... *E06B 9/582* (2013.01); *E06B 7/28* (2013.01); *E06B 9/327* (2013.01); *E06B 9/388* (2013.01);
(Continued)

(58) Field of Classification Search
CPC ... E06B 7/28; E06B 9/582; E06B 9/24; E06B 9/327; E06B 9/388; E06B 9/17076; E06B 9/42; E06B 2009/587; E06B 2009/588
See application file for complete search history.

(56) References Cited

U.S. PATENT DOCUMENTS 4,114,233 A 9/1978 Hamilton
4,333,511 A 6/1982 Johnston
(Continued)

FOREIGN PATENT DOCUMENTS

CN 204663356 U 9/2015
CN 205189719 U 4/2016
(Continued)

OTHER PUBLICATIONS

"Installation Solar Blackout Channels", Springs Window Fashions, Architectural Website: www.swfcontract.com, 4 pages.
(Continued)

*Primary Examiner* — Beth A Stephan

(57) ABSTRACT

A perimeter light blockout system for minimizing light leakage between light gaps such as, for example, between the sides of a covering (e.g., shade) of an architectural-structure covering and the interior side surfaces of a window frame, or between the covering and the outer surface of an interior wall is disclosed. The perimeter light blockout system including a light blocking device and a mounting element for coupling the light blocking device to the interior side surface of the window frame, or the outer surface of the interior wall. The light blocking device may include rear and
(Continued)

front channel members. The mounting element may be a mounting extrusion. Alternatively, the mounting element may be a spring clip. In use, the light blocking device may be adapted and configured so as not to contact the covering as the covering moves between extended and retracted positions. The mounting element may include a degree of adjustment so that the light blocking device may be aligned with an out-of-skew window frame.

21 Claims, 19 Drawing Sheets

(51) Int. Cl.

| | |
|---|---|
| ***E06B 7/28*** | (2006.01) |
| ***E06B 9/388*** | (2006.01) |
| *E06B 9/42* | (2006.01) |
| *E06B 9/17* | (2006.01) |

(52) U.S. Cl.
CPC ..... *E06B 9/17076* (2013.01); *E06B 9/42* (2013.01); *E06B 2009/587* (2013.01); *E06B 2009/588* (2013.01)

(56) References Cited

U.S. PATENT DOCUMENTS

| | | | | |
|---|---|---|---|---|
| 4,357,978 | A | 11/1982 | Keller et al. | |
| 4,419,982 | A | 12/1983 | Eckels | |
| 4,458,739 | A | 7/1984 | Murray et al. | |
| 4,463,792 | A | 8/1984 | Lukos | |
| 4,516,618 | A * | 5/1985 | Gardner | E06B 9/17046 160/120 |
| 4,987,943 | A * | 1/1991 | Charest | E06B 9/54 160/120 |
| 5,117,892 | A * | 6/1992 | Murray | E06B 9/54 160/269 |
| 5,127,458 | A | 7/1992 | Schaefer et al. | |
| 5,226,466 | A | 7/1993 | Coddens | |
| 5,445,209 | A * | 8/1995 | Lichy | E06B 9/13 160/273.1 |
| 5,462,105 | A | 10/1995 | Supernak | |
| 5,482,104 | A * | 1/1996 | Lichy | E06B 9/13 160/273.1 |
| 5,524,689 | A | 6/1996 | Clark | |
| 5,769,562 | A * | 6/1998 | Jones | E01C 11/221 404/7 |
| 6,161,607 | A | 12/2000 | de Kimpe et al. | |
| 6,269,591 | B1 * | 8/2001 | Kelly | E04G 21/30 49/482.1 |
| 6,412,538 | B1 | 7/2002 | Welfonder | |
| 6,655,440 | B2 * | 12/2003 | Brunk | E06B 7/2309 160/229.1 |
| 6,666,251 | B2 | 12/2003 | Ikle | |
| 6,866,079 | B2 | 3/2005 | Lee | |
| 7,093,643 | B2 | 8/2006 | Ikle | |
| 8,371,355 | B2 | 2/2013 | Santoro et al. | |
| 8,439,099 | B1 | 5/2013 | Crider | |
| 9,027,626 | B2 | 5/2015 | Marocco | |
| 9,115,532 | B1 | 8/2015 | Sherman | |
| 9,140,058 | B1 | 9/2015 | James | |
| 9,234,381 | B2 | 1/2016 | Wexler et al. | |
| 9,238,938 | B2 | 1/2016 | Sherman | |
| 9,247,840 | B2 | 2/2016 | Diamond et al. | |
| 9,447,634 | B2 | 9/2016 | Williams et al. | |
| 10,221,561 | B2 * | 3/2019 | Siller | A62C 3/14 |
| 10,465,439 | B2 * | 11/2019 | Rissone | E06B 7/2312 |
| 2006/0000559 | A1 | 1/2006 | Bohlen | |
| 2007/0277937 | A1 | 12/2007 | Su | |
| 2009/0101293 | A1 | 4/2009 | Anderson et al. | |
| 2011/0005153 | A1 * | 1/2011 | Schield | E06B 1/68 52/204.53 |
| 2011/0061300 | A1 | 3/2011 | Fisher et al. | |
| 2012/0012261 | A1 * | 1/2012 | Santoro | E06B 9/582 160/272 |
| 2012/0193038 | A1 | 8/2012 | Corey et al. | |
| 2013/0067835 | A1 | 3/2013 | Chou | |
| 2014/0033610 | A1 | 2/2014 | Watkins et al. | |
| 2015/0197985 | A1 * | 7/2015 | Balay | E06B 9/17076 160/271 |
| 2016/0002970 | A1 | 1/2016 | Williams et al. | |
| 2016/0222721 | A1 | 8/2016 | Rettig | |
| 2016/0356084 | A1 | 12/2016 | Williams et al. | |
| 2018/0044977 | A1 * | 2/2018 | Bonnell | E06B 9/15 |

FOREIGN PATENT DOCUMENTS

| | | | |
|---|---|---|---|
| DE | 3721921 | C1 | 2/1989 |
| DE | 19823853 | A1 | 11/1998 |
| EP | 3333353 | A1 | 6/2018 |
| FR | 2373663 | A1 | 7/1978 |
| KR | 100856534 | B1 | 9/2008 |
| WO | 91/14071 | A1 | 9/1991 |

OTHER PUBLICATIONS

"Side and Bottom Channel Installation Instructions", Roll-A-Shade, Aug. 12, 2013, www.rollashade.com, 1 page.
"Installation Instructions-LightBloc Zip by Draper", Draper Inc., Copyright 2015, www.draperinc.com, 4 pages.
"Block light that creeps through the sides of blackout window shades", Sleepy Time Tracks, www.sleepytimetracks.com, 9 pages.
EP Search Report from EP18165182, dated Aug. 23, 2018, 8 pgs.
Bloc Blinds 'BlocOut' blackout blinds—review; http://thomashallett.com/blocout-blackout-blinds-review/, dated Jul. 24, 2016, 16 pgs.

* cited by examiner

PERIMETER LIGHT BLOCKOUT SYSTEM

CROSS-REFERENCE TO RELATED APPLICATIONS

This is a non-provisional of, and claims the benefit of the filing date of, U.S. provisional patent application No. 62/479,500, filed Mar. 31, 2017, titled "Perimeter Light Blockout System," and a non-provisional of, and claims the benefit of the filing date of, U.S. provisional patent application No. 62/622,990, filed Jan. 29, 2018, titled "Perimeter Light Blockout System," the entirety of which applications are incorporated by reference herein.

FIELD OF THE DISCLOSURE

The present disclosure relates generally to the field of architectural-structure coverings, and relates more particularly to a perimeter light blockout system that prevents unwanted light from passing through the gap created, for example, between the sides of the covering and the window frame, or between the covering and an outer surface of an interior wall.

BACKGROUND

Architectural-structure coverings, such as honeycomb shades, slat blinds, Venetian blinds, roller shades, blackout shades, Roman shades, etc. may be used to selectively cover a window to provide privacy and block incoming light from the window. In addition, architectural-structure coverings may also be used to selectively cover a doorway, a skylight, a hallway, a portion of a wall, etc. Horizontal architectural-structure coverings may include a covering that can be vertically extendable and retractable (e.g., able to be lowered or raised, respectively, in a vertical direction) relative to a horizontally-oriented headrail between an extended position and a retracted position for obscuring and exposing, respectively, an underlying architectural structure such as a wall or an opening (such as, for example, a window).

One common problem with architectural-structure coverings is that the mounting hardware and actuators needed for the architectural-structure covering to operate effectively typically require the covering of the architectural-structure covering to be slightly narrower than the underlying structure (e.g., window opening). For example, in the case of an interiorly mounted roller shade or honeycomb shade, mounting brackets are typically mounted at the top of the window opening (e.g., brackets may be attached to a top surface or jamb of the window opening or on opposite side surface or jambs thereof). In either event, for the shade to fit into the mounting bracket and function properly, the covering is offset from either side of the window opening, leaving a side gap along the length of the covering between the sides of the shade and the interior side surfaces of the window frame. The side gap enables unwanted light to pass therethrough. The same problem exists for Venetian blinds, Roman shades, and other architectural-structure coverings where the mounting hardware is placed inside the window frame. The gap at either side may be even more significant if the architectural-structure covering includes complex or large actuators such as tilt rods, operating cords, and the like that require additional space accommodations. The resultant side gap not only allows unwanted light to leak through but it also can result in an architectural-structure covering that appears unfinished or otherwise unsightly. Accordingly, there is a need in the art to provide a mechanism to prevent unwanted light from leaking through the sides along the length of the covering.

A similar problem exists in connection with exterior mounted architectural-structure coverings. For example, in exterior mounted architectural-structure coverings, the architectural-structure covering may be mounted to an outer surface of an interior wall adjacent to a window opening (e.g., mounted to the wall above the window opening). In this embodiment, the sides of the architectural-structure covering may extend laterally beyond the window frame. As a result, light gaps often exist that enable unwanted light to pass therethrough. For example, light gaps may exist between the covering and the outer surface of the interior wall.

In addition, the architectural-structure covering should provide a satisfactory and proper alignment with respect to the underlying architectural structure. While problems associated with an imperfect fit may be less critical for some architectural-structure coverings, other coverings such as, for example, shades require a rather precise alignment. A shade that does not fit properly within the window opening may be aesthetically deficient.

There may be any number of reasons for an unsatisfactory fit of a window covering system. Most obviously, the window opening or window frame may be out of alignment (e.g., an out-of-skew window frame). As an out-of-skew window frame may be out of the user's control, the need for an alignment adjusting mechanism or device becomes even more important. The need is particularly significant in connection with the installation of some modern, highly decorative window covering systems, where improper geometric alignment can result in an unsightly shade system. These aesthetic and function problems may be annoying and unsightly to the user.

SUMMARY

It is with respect to the above and other considerations that the present improvements may be useful. As it would be desirable to provide a perimeter light blockout system that prevents unwanted light from passing through light gaps, such as, for example, to minimize the amount of light passing between a side of a covering and an interior side surface of a window frame, or to minimize the amount of light passing between the covering and an outer surface of an interior wall. In addition, the perimeter light blockout system preferably also facilitates alignment adjustment to facilitate proper alignment even when installed within an imperfect window frame (e.g., an out-of-skew window frame).

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Disclosed herein is an improved perimeter light blockout system for minimizing an amount of light passing between any light gaps, such as, for example, any gaps between a side of a covering and an interior side surface of a window frame, or between the covering and an outer surface of an interior wall. In one embodiment, the perimeter light blockout system includes a light blocking device and a mounting element for coupling the light blocking device to the interior side surface of the window frame, or the outer surface of the interior wall. In use, the light blocking device may be adapted and configured so as not to contact the covering as the covering moves between extended and retracted positions.

In one embodiment, the light blocking device includes a U-shaped channel sized and shaped so as not to contact the covering received therein (e.g., portions (e.g., sides) of the covering received between the interior surfaces of the light blocking device) as the covering moves between the extended and retracted positions. That is, the interior surfaces may be separated by a distance greater than the depth or thickness of the covering received therein so that a space exists between interior surfaces of the light blocking device and the window side of the covering and the room side of the covering, respectively. In this manner, the light blocking device does not contact the covering and thus minimizes wear on the covering. In addition, because of the spaces formed between the interior surfaces of the light blocking device and the interior surfaces of the covering, air flow is enabled between the window side of the covering and the room side of the covering.

In another embodiment, disclosed herein is an improved perimeter light blockout system for minimizing an amount of light passing between any light gaps, such as, for example, any gaps between a side of a covering and an interior side surface of a window frame, or between the covering and an outer surface of an interior wall. The perimeter light blockout system includes a light blocking device and a mounting element for coupling the light blocking device to the interior side surface of the window frame, or the outer surface of the interior wall. The mounting element may provide a degree of adjustment so that the light blocking device can be aligned with an out-of-skew window frame. In use, the mounting element may releasably couple the light blocking device with respect to the window frame to enable a user to remove all or part of the light blocking device.

The light blocking device may include a channel for receiving a portion of the covering therein. The light blocking device may include a rear channel member releasably coupled to a front channel member. The light blocking device may be in the form of a U-shaped member so that portions of the covering may be received within the channel of the U-shaped member.

In one example embodiment, at least a portion of the channel includes a light absorbing/reflecting inner surface. The light absorbing/reflecting inner surface may include a plurality of serrations for reflecting light back in the direction from which it came, thereby minimizing the amount of light that may be transmitted through gaps between the light blocking device and the covering of the architectural-structure covering.

In one example embodiment, the perimeter light blockout system includes a cap coupled to the light blocking device. In use, the cap may be adjustably positioned with respect to the light blocking device to prevent any light seeping through a gap formed between, for example, a top edge of the light blocking device and a top edge of the window frame.

In one example embodiment, the perimeter light blockout system includes a bottom rail light blocking mechanism for coupling to a bottom rail of an architectural-structure covering so that, in the fully extended position, the bottom rail light blocking mechanism interacts with an interior bottom surface of the window frame for preventing light from passing between the bottom rail of the architectural-structure covering and the bottom surface of the window frame.

The present invention also discloses a method for minimizing an amount of light passing between any light gaps such as, for example, side gaps between a side of a covering and an interior side surface of a window frame, or between the covering and the outer surface of an interior wall. The method includes coupling one or more mounting elements to the interior side surface of the window frame, or the outer surface of an interior wall; releasably coupling a light blocking device to the one or more mounting elements; and adjusting the position of the light blocking device with respect to the one or more mounting elements. Releasably coupling the light blocking device to the one or more mounting elements may include ratchetably engaging one or more projections on the light blocking device with a pair of arms on the one or more mounting elements so that a position of the light blocking device can be incrementally adjusted with respect to the one or more mounting elements.

BRIEF DESCRIPTION OF THE DRAWINGS

By way of example, a specific embodiment of the disclosed device will now be described, with reference to the accompanying drawings.

Embodiments of a perimeter light blockout system for architectural-structure coverings in accordance with the present disclosure will now be described more fully hereinafter with reference to the accompanying drawings, in which preferred embodiments of the present disclosure are presented. The following disclosure is intended to provide illustrative embodiments of the disclosed apparatus, system, and method, and these example embodiments should not be interpreted as limiting. The perimeter light blockout system of the present disclosure may, however, be embodied in many different forms and should not be construed as being limited to the embodiments set forth herein. Rather, these embodiments are provided so that this disclosure will convey certain example aspects of the perimeter light blockout system to those skilled in the art. In the drawings, like numbers refer to like elements throughout unless otherwise noted. One of ordinary skill in the art will understand that the methods disclosed may easily be reordered and manipulated into many configurations, provided they are not mutually exclusive.

DETAILED DESCRIPTION

Figure 1:
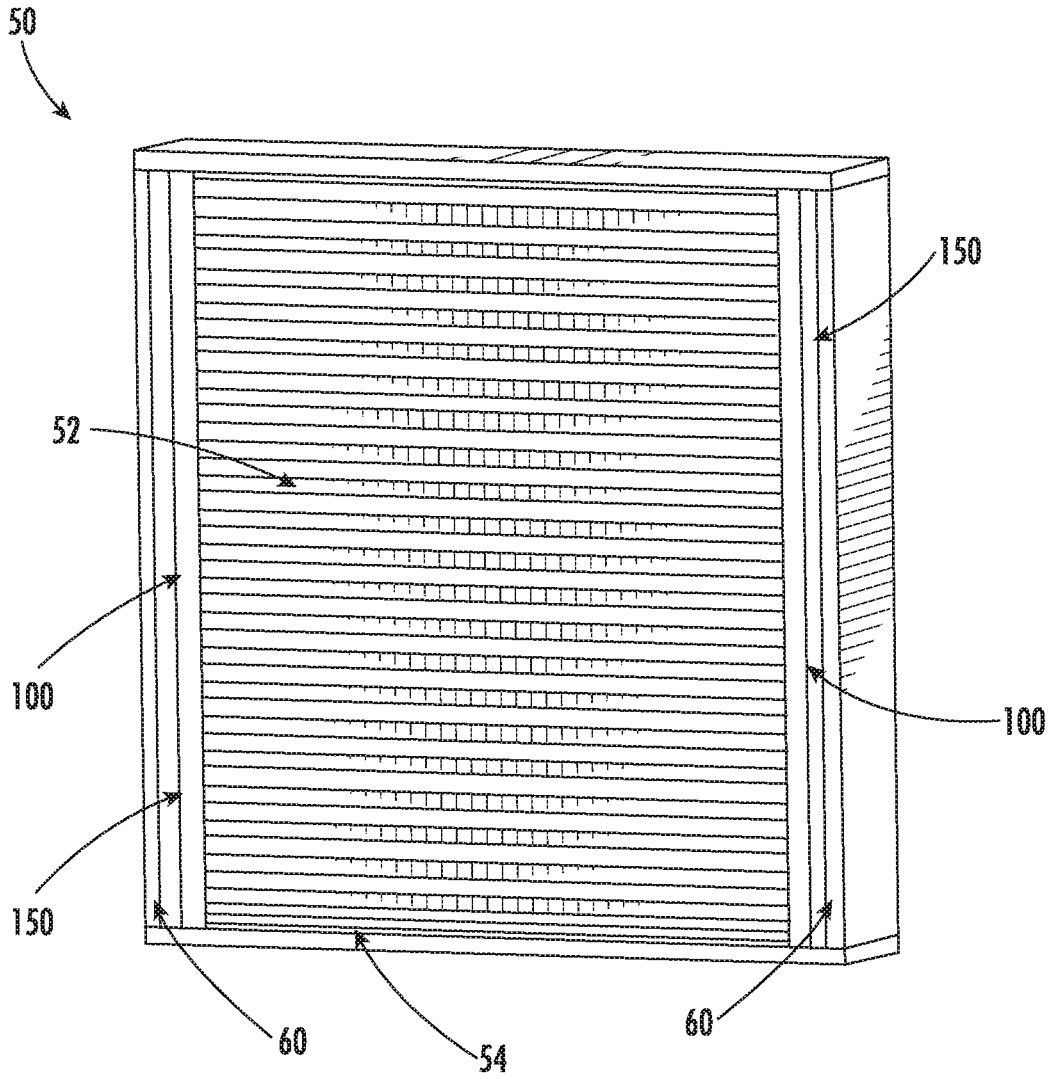
FIG. 1 is a front, perspective view illustrating an architectural-structure covering and a perimeter light blockout system in accordance with an illustrative embodiment of the present disclosure.

As will be described in greater detail below, the perimeter light blockout system of the present disclosure is configured to minimize light leakage between the sides of the covering (e.g., shade) and the interior side surfaces of the window frame or jamb, or between the covering and an outer surface of an interior wall depending on the type of perimeter light blockout system being utilized (interior mount or exterior mount system). In one embodiment, the light blocking device may be adapted and configured so as not to contact any portion of the covering as the covering moves between the extended and retracted positions. In addition, the perimeter light blockout system of the present disclosure may be configured to provide a degree of alignment when installed within an out-of-skew window frame. The perimeter light blockout system may include a light blocking device and a mounting element for coupling the light blocking device to the interior side surface of the window frame, or the outer surface of the interior wall. In one embodiment, the interaction between the mounting element and the light blocking device is arranged and configured to provide the degree of adjustment so that the light blocking device can be aligned with an out-of-skew window frame.

In use, the mounting element is arranged and configured to mount to either the interior side surface of the window frame for interior mounted systems, or the outer surface of the interior wall for exterior mounted systems, to facilitate mounting of the light blocking device thereto. The light blocking device is arranged and configured to interact with the covering of the architectural-structure covering to prevent or minimize the amount of light passing through gaps between the light blocking device and the covering such as, for example, through the sides of the covering (e.g., shade) and the interior side surfaces of the window frame or jamb, or between the covering and the outer surface of the interior wall.

In one embodiment, the mounting element releasably couples the light blocking device to the window frame or interior wall to enable a user to remove all or part of the light blocking device. That is, the mounting element may releasably couple the light blocking device to the window frame or interior wall so that, as needed, the light blocking device can be temporarily removed to, for example, facilitate cleaning of the window. The mounting element could be any device for coupling, and more preferably, releasably coupling, the light blocking device to the window frame or interior wall. For example, the mounting element may be Velcro, magnets (e.g., magnetic members may be attached to the window frame or interior wall, and to the light blocking device), etc. In one embodiment, for example, the mounting element may be a mounting extrusion for releasably coupling the light blocking device to the window frame or interior wall. In another embodiment, the mounting element may be or one or more clips for releasably coupling the light blocking device to the window frame or interior wall.

In one embodiment, the mounting extrusion includes first and second arms for engaging a portion of the light blocking device. The associated clips include first and second arms for engaging a portion of the light blocking device. The light blocking device may include one or more projections extending from the light blocking device. In one embodiment, the light blocking device includes first and second projections extending away from the light blocking member. The first and second projections may include a plurality of serrations. In use, the first and second arms of the mounting extrusion or clips engage the first and second projections of the light blocking device, respectively. The first and second arms may engage the plurality of serrations formed on the projections so that the first and second arms are incrementally adjustable with respect to the projections, thus allowing the user to adjust the position of the light blocking device with respect to the mounting element and hence with respect to the interior side surface of the window frame, or outer surface of the interior wall. In addition, the first and second arms may be arranged and configured to disengage from the projections extending from the light blocking device so that the light blocking device can be selectively decoupled from the mounting extrusion or clips if desired.

In one embodiment, the light blocking device includes a channel for receiving a portion of the covering therein. The light blocking device may include a rear channel member releasably coupled to a front channel member. When coupled, the light blocking device may be in the form of a U-shaped member so that portions of the covering may be received within a U-shaped channel of the light blocking device. The front channel member may be coupled to the rear channel member by any mechanism. For example, the front channel member may include an internal recess for receiving a longitudinally extending portion of the rear channel member. The longitudinally extending portion may include a detent for contacting the internal recess.

In one embodiment, the channel of the light blocking device may include a light absorbing/reflecting inner surface. The light absorbing inner surface may include a plurality of serrations, each serration including an angled first surface and a second surface, the first and second surfaces terminating in a tip. In use, the angled surfaces of the serrations reflect the light back in the direction of its source.

The perimeter light blockout system may include a bottom rail light blocking mechanism for coupling to a bottom rail of an architectural-structure covering so that, in the fully extended position, the bottom rail light blocking mechanism interacts with an interior bottom surface of the window frame for preventing light from passing between the bottom rail of the architectural-structure covering and the bottom surface of the window frame. The bottom rail light blocking mechanism may include a semi-circular flexible dome for contacting the bottom surface of the window frame.

Figure 2:
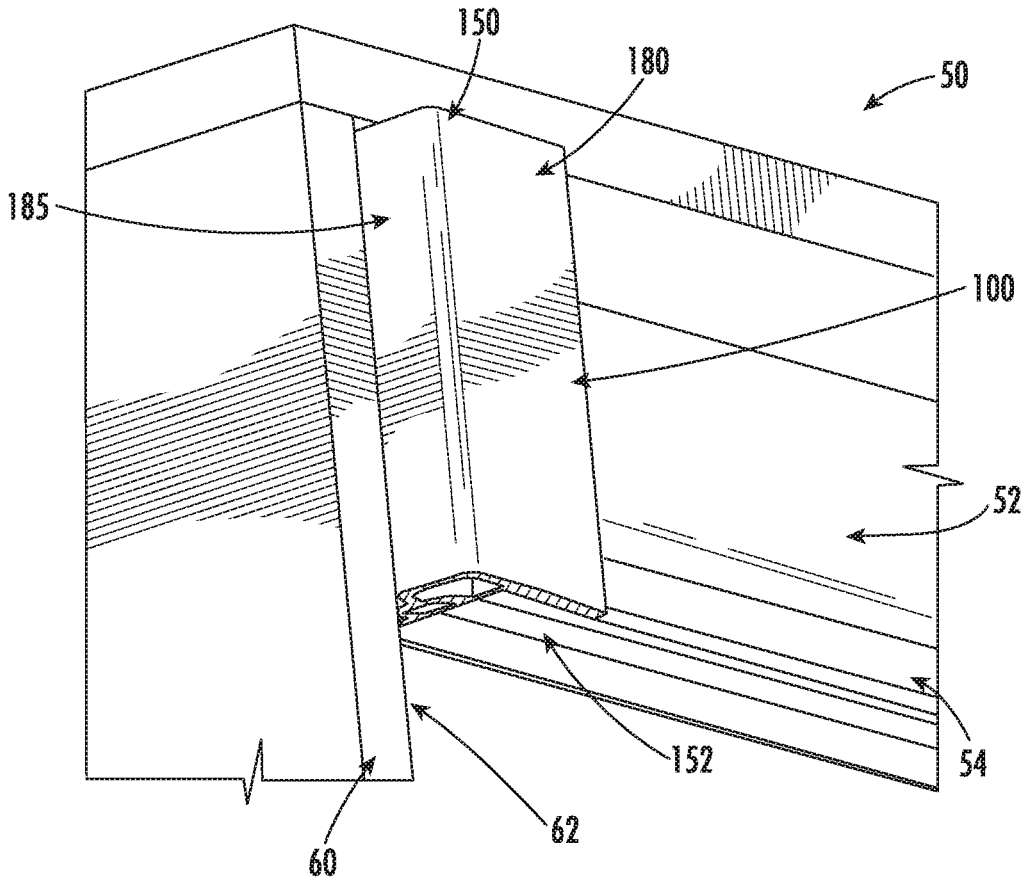
FIG. 2 is a partial, front, perspective view illustrating an example of an embodiment of a perimeter light blockout system with an architectural-structure covering in accordance with the present disclosure.

Referring to FIGS. 1 and 2, a perimeter light blockout system 100 in accordance with an illustrative, non-limiting embodiment of the present disclosure is shown. For the sake of convenience and clarity, terms such as "front," "rear," "top," "bottom," "up," "down," "vertical," and "horizontal" may be used herein to describe the relative placement and orientation of various components and portions of the perimeter light blockout system 100. Said terminology will include the words specifically mentioned, derivatives thereof, and words of similar import.

Referring to FIG. 1, an architectural-structure covering 50, for example, a shade, may be installed in a window opening. The architectural-structure covering 50 may be any covering now known or hereafter developed including, for example, but not limited to, a honeycomb shade. Architectural-structure coverings 50 may be coupled to the interior side surfaces 62 (best shown in FIGS. 2 and 17) of the window frame 60 on opposite, lateral sides of the window. The architectural-structure covering 50 may include a covering 52 that can be vertically extendable and retractable (e.g., able to be lowered or raised, respectively, in a vertical direction) relative to a horizontally-oriented headrail between an extended position and a retracted position for obscuring and exposing, respectively, an underlying architectural structure such as a wall or an opening (such as, for example, a window). Architectural-structure coverings are well known and require no additional description herein.

Figure 17:
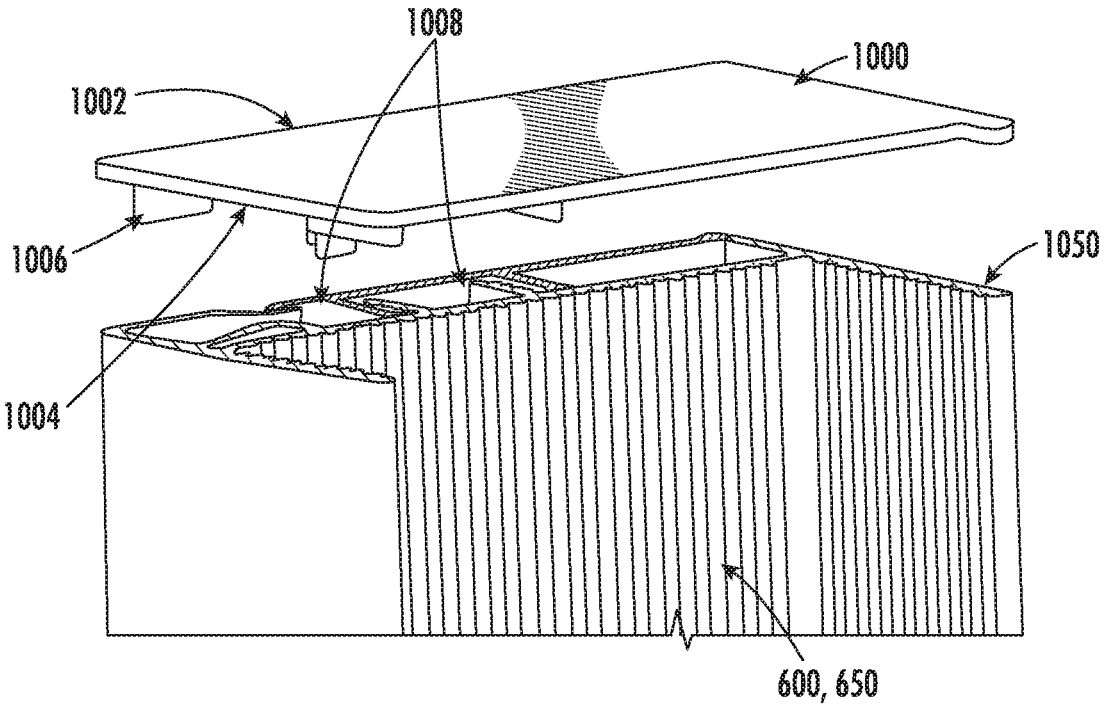
FIG. 17 is a detailed, partially exploded view of an alternate embodiment of a cap used in connection with a perimeter light blockout system.

Referring to FIGS. 1, 2, and 17, in use, for example, for architectural-structure coverings 50 where the covering 52 is mounted within the window frame (e.g., commonly referred to as an interiorly mounted system), the lateral width of the window opening as measured between the interior side surfaces 62 of the window frame 60 is often greater than the width of the covering 52. Thus, light gaps generally exist and extend along and between the sides of the covering 52 and the interior side surfaces 62 of the window frame 60. This is in contrast with exteriorly mounted systems, where for example, the architectural-structure covering 50 is mounted to the outer surface of an interior wall adjacent to a window opening, for example, to the interior wall above the window opening. For exterior mounted systems, the sides of the architectural-structure covering 50 may extend laterally beyond the interior side surfaces 62 of the window frame 60. As such, in use, the lateral width of the architectural-structure covering 50 is greater than the lateral width of the window opening as measured between the interior side surfaces 62 of the window frame 60. In either event, light gaps typically are formed and it is desirable to provide a light blocking mechanism for occupying the existing light gaps and obstructing light from passing through the light gaps and into the room.

Figure 3:
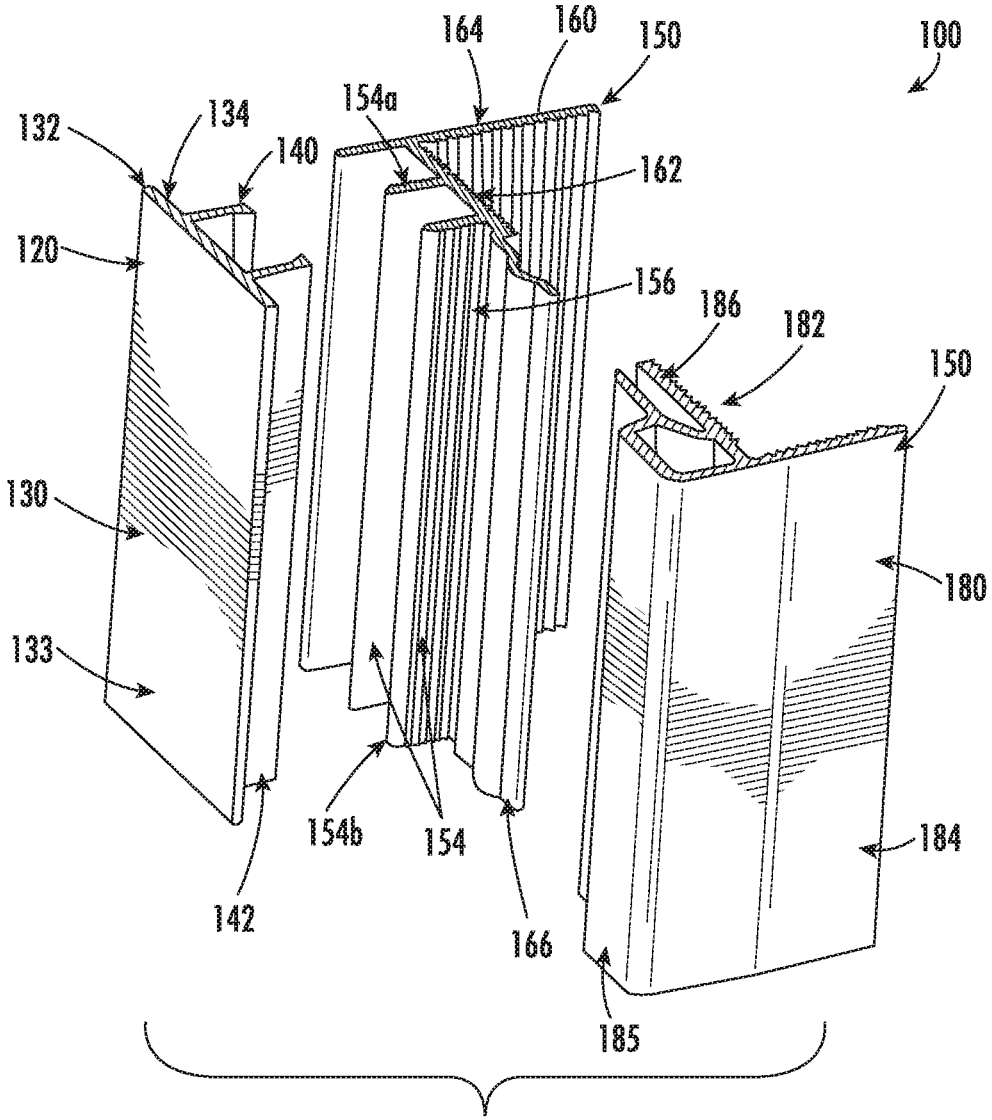
FIG. 3 is an exploded perspective view illustrating the perimeter light blockout system shown in FIG. 2.

The perimeter light blockout system 100 generally includes a mounting element 120 and a light blocking device 150. Referring to FIGS. 2-5, a first embodiment of an illustrative perimeter light blockout system 100 is shown. Referring to FIG. 3, the mounting element 120, in use, couples the light blocking device 150 to the window frame 60 (FIG. 2). The mounting element 120 may be attached to the interior side surface or jamb 62 (FIG. 2) of the window opening for coupling the light blocking member 150 to the window frame 60. The mounting element 120 may be any structure for mounting the light blocking member 150 to the window frame 60. For example, the mounting element 120 may be an adhesive, one or more fasteners or nails, brackets, etc. In one non-limiting example embodiment, the mounting element 120 may be configured to releasably connect the light blocking member 150 to the window frame 60 to enable a user to remove all or part of the light blocking member 150 from the window frame 60 so that the user can, for example, better access the window to clean it. For example, the mounting element 120 may be Velcro, magnets (e.g., magnetic members may be attached to the window frame 60 and to the exterior surface of the light blocking device 150), etc.

Figure 4:
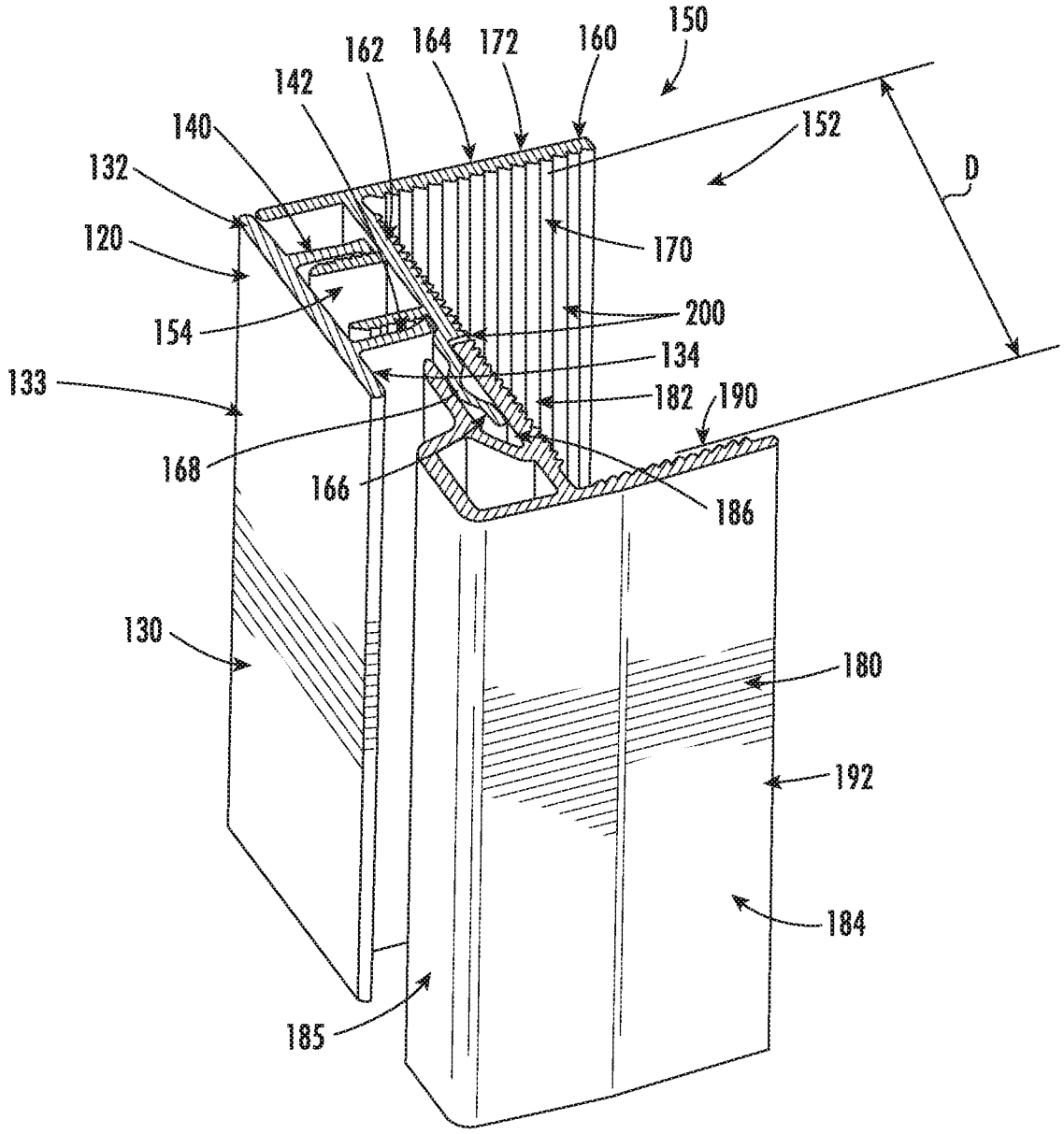
FIG. 4 is a perspective view illustrating the perimeter light blockout system shown in FIG. 2.
Figure 5:
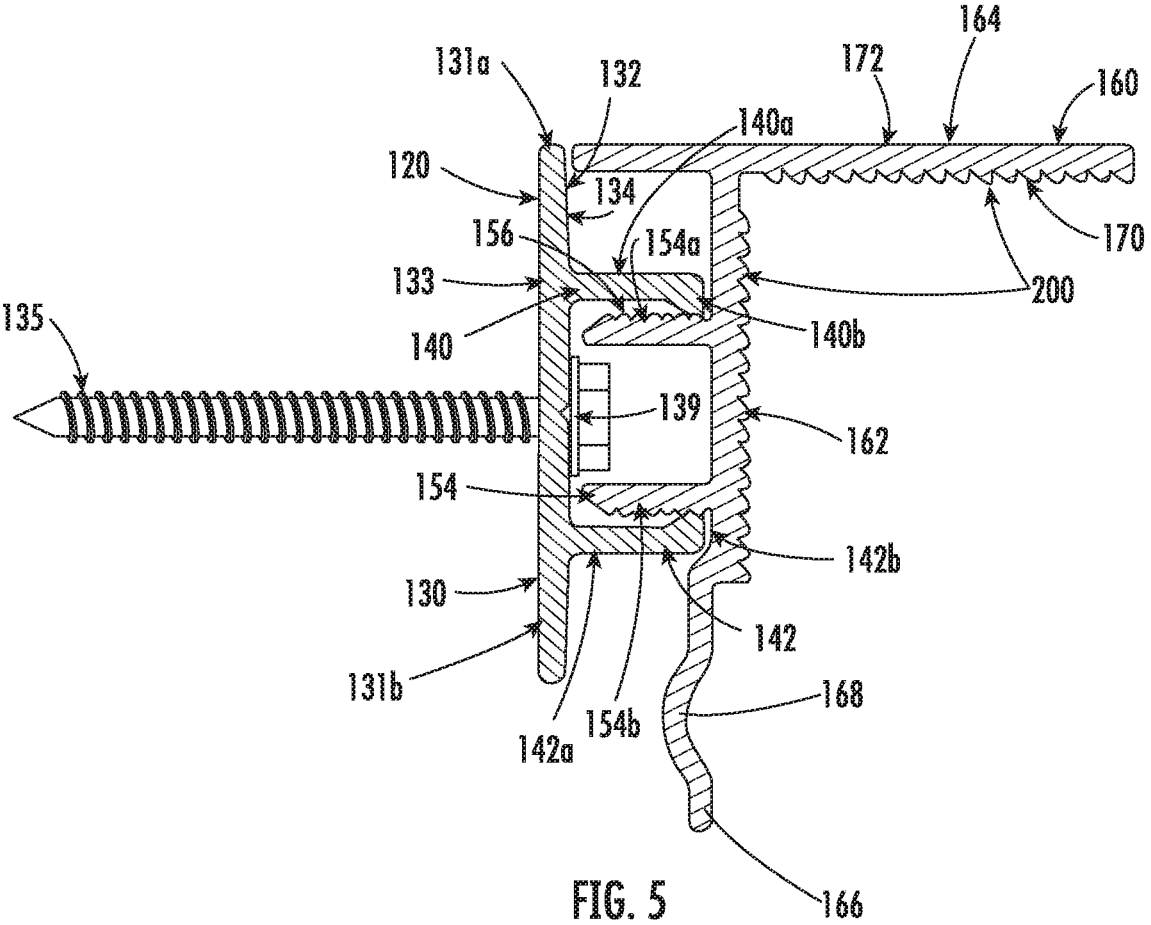
FIG. 5 is a partial, cross-section view illustrating the perimeter light blockout system shown in FIG. 2.

Referring to FIGS. 3, 4 and 5, in one embodiment, the mounting element 120 is a mounting extrusion 130 for releasably coupling the light blocking member 150 to the window frame 60. Specifically, in one embodiment, the mounting extrusion 130 removably mounts the light blocking device 150 to the interior side surface 62 of the window frame 60 so that the light blocking device 150 can be easily removed as desired. The mounting extrusion 130 may include a base member 132. The base member 132 includes a window frame coupling surface 133 and a light blocking surface 134 opposite thereof. The window frame coupling surface 133 may be in the form of a planar surface for contacting the interior side surface 62 of the window frame 60. In use, the mounting extrusion 130 may be coupled to window frame 60 by any coupling mechanism known including, but not limited to, adhesive strips, two-face backing tape, Velcro, magnetics, etc. In one embodiment, the base member 132 may include one or more holes (not shown) or other features for receiving fasteners 135 for coupling the mounting extrusion 130 to the window frame 60. The holes may be slotted to enable additional lateral adjustability. In one embodiment, the mounting extrusion 130 may extend the entire height of the window frame. In this manner, the mounting extrusion 130 helps to prevent or minimize the amount of light seeping through the gap formed between the edge of the covering 52 and the interior side surface 62 of the window frame 60.

Referring to FIG. 5, the mounting extrusion 130 may include first and second upstanding arms 140, 142 for engaging a portion of the light blocking device 150. The first and second upstanding arms 140, 142 may include a first portion 140*a*, 142*a*, respectively, that extends generally perpendicular with respect to the light blocking surface 134 and a second portion 140*b*, 142*b*, respectively, that extends generally perpendicular with respect to the first portion 140*a*, 142*a*, respectively. The first and second upstanding arms 140, 142 may be integrally formed with the base member 132. Alternatively, the first and second upstanding arms 140, 142 may be coupled to the base member 132 by any means now known or hereafter developed, including, but not limited to, an adhesive, welding, fasteners, etc.

As will be described in greater detail below, the first and second arms 140, 142 of the mounting extrusion 130 are configured to receive a projection 154 formed on or connected to the light blocking device 150. In one embodiment, the projection 154 includes a plurality of serrations 156 formed thereon so that the first and second arms 140, 142 may incrementally engage the projection 154, similar to a ratchet-type connection. In this manner, by incrementally adjusting the position of the projection 154 with respect to the arms 140, 142, the user can adjust the position of the light blocking device 150 with respect to the window frame 60 to assist with proper alignment of the light blocking device 150, for example, with respect to an out-of-skew window frame 60. In addition, by incorporating the mounting extrusion 130, the process of coupling the light blocking device 150 is substantially hands free (e.g., no need for extra tools, such as, a wrench, a screwdriver, etc., to tighten; the user just presses the light blocking device 150 into contact with the mounting extrusion 130).

In use, after the mounting extrusion 130 has been coupled to the interior side surface 62 of the window frame 60 via, for example, one or more fasteners 135, the light blocking device 150 is coupled to the mounting extrusion 130. For example, the projection 154 formed on or connected to the light blocking device 150 may be coupled to the first and second arms 140, 142 formed on or extending from the mounting extrusion 130. In one embodiment, the second portions 140*b*, 142*b* of the first and second arms 140, 142 may ratchetably couple to the plurality of serrations 156 formed on the projection 154 formed on or connected to the light blocking device 150.

In use, applying a force to the light blocking device 150 causes the first and second arms 140, 142 to move (e.g., separate) with respect to each other. In this manner, the light blocking device 150 may be coupled to and removable from the mounting extrusion 130. That is, for example, the first and second arms 140, 142 of the mounting extrusion 130 may be arranged so that applying a compressive force against the light blocking device 150 (e.g., pressing the light blocking device 150 against the mounting extrusion 130 with the projection 154 located between the first and second arms 140, 142), causes the first and second arms 140, 142 to move away from each other so that the light blocking device 150 can be coupled to the mounting extrusion 130. Similarly, applying a pulling force to the light blocking device 150, causes the first and second arms 140, 142 to move away from each other so that the light blocking device 150 can be decoupled from the mounting extrusion 130.

Referring to FIG. 5, the base member 132 may include a flexible portion 139 such as, for example, a groove formed in the light blocking surface 134. The flexible portion 139, in use, allows the base member 132 to conform to the interior side surface 62 of the window frame 60. That is, initially, the flexible portion (e.g., groove) 139 may act as a locating groove to assist the installer to center a drill and screw when installing the mounting extrusion 130 to the interior side surface 62 of the window frame 60. In addition, referring to FIG. 5, the flexible portion 139 allows for surfaces of the base member 132 on opposite sides of the flexible portion 139 to angle away from the main body portion to ensure enhanced surface area contact between the first and second edges 131*a*, 131*b* of the mounting extrusion 130 and the interior side surface 62 of the window frame 60, thus enabling a tighter light seal with the interior side surface 62 of the window frame 60.

Referring to FIGS. 2 and 4, the illustrated light blocking device 150 includes a channel 152 for receiving a portion (e.g., sides) of the covering 52 of the architectural-structure covering 50 therein. As shown, the light blocking device 150 may be in the form of a U-shaped channel. Preferably, the light blocking device 150 may include a rear (e.g., window side) channel member 160 and a front (e.g., room side) channel member 180. In the example embodiment shown, the rear and front channel members 160, 180 each have an approximate L-shape so that when the front channel member 180 is coupled to the rear channel member 160, the light blocking device 150 has an approximate U-shaped channel 152 for receiving the architectural-structure covering (e.g., shade) therein. The U-shaped channel 152 may be sized and shaped so as not to contact the covering 52 received therein as the covering 52 moves from between the extended and retracted positions.

The rear channel member 160 may include a base member 162 that when installed extends generally parallel to the interior side surface 62 of the window frame 60 and a rear wall portion 164 that extends generally perpendicular from the base member 162. Similarly, the front channel member 180 includes a base member 182 that when installed extends generally parallel to the interior side surface 62 of the window frame 60, and a front wall portion 184 that extends generally away from the base member 182. As shown, the front wall portion 184 of the front channel member 180 may initially extend perpendicularly from the base member 182. However, the front wall portion 184 may be angled inwardly towards the rear channel member 160. However, it should be understood that the front wall portion 184 may have any profile to provide alternative aesthetic appearances. In this manner, the end portion of the covering 52 may reside within the U-shaped channel 152. As such, the rear wall portion 164 of the rear channel member 160 and the front wall portion 184 of the front channel member 180 may extend beyond (e.g., overlap with) the end portions of the covering 52 of the architectural-structure covering 50, and hence, extend across the light gap formed between the sides of the covering 52 and the interior side surfaces 62 of the window frame 60, and thereby prevents light from seeping through.

Referring to FIGS. 2-4, the front channel member 180 may include a finished front portion 185 that, in use, extends laterally aligned with or beyond the window frame coupling surface 133 of the mounting extrusion 130. In this manner, the perimeter light blockout system 100, and specifically, the front channel member 180 has a pleasing aesthetic appearance while the mounting extrusion 130 and the rear channel member 160 are substantially blocked from view.

The front and rear channel members 160, 180 may be coupled to each other by any means now known or later developed. As shown in FIGS. 3-5, the base member 182 of the front channel member 180 includes an internal recess 186 for receiving a longitudinally extending portion or stem 166 formed on the rear channel member 160. The longitudinally extending portion or stem 166 may be integrally formed with the base member 162 of the rear channel member 160. In this manner, the user may slidably couple the front channel member 180 to the rear channel member 160. That is, the longitudinally extending portion or stem portion 166 may be slidably received within the internal recess 186 formed in the base member 182 of the front channel member 180. Referring to FIGS. 4 and 5, the longitudinally extending portion or stem 166 may include a detent 168, either coupled thereto or integrally formed with the stem portion 166, so that the front channel member 180 is positively coupled to the rear channel member 160, thus minimizing the possibility that the front channel member 180 may become inadvertently disengaged from or shift (e.g., move) with respect to the rear channel member 160. The detent 168 may be in the form of a flexible, arcuate curved surface that is configured to contact an inner surface of the internal recess 186 so that upon insertion, the arcuate curved surface contacts and compresses against the inner surface of the internal recess 186, so that the front channel member 180 is positively frictionally coupled to the rear channel member 160. Alternatively, the front channel member 180 may be additionally coupled to the rear channel member 160 by any other means now known or later developed. As will be appreciated by one of ordinary skill in the art, the internal recess 186 and the longitudinally extending portion or stem portion 166 may be interchangeable. That is, the front channel member 180 may include the longitudinally extending portion or stem 166 while the rear channel member 160 may include the internal recess 186.

Each of the rear and front channel members 160, 180 includes an interior surface 170, 190 (e.g., surface that faces the covering 52 of the architectural-structure covering 50) and exterior surface 172, 192 (e.g., surface opposite the interior surface). As previously mentioned, the U-shaped channel 152 may be sized and shaped so as not to contact the covering 52 received therein (e.g., portions (e.g., sides) of the covering 52 received between the interior surfaces 170, 190 of the light blocking device 50) as the covering 52 moves between the extended and retracted positions. That is, as illustrated in FIG. 4, the interior surfaces 170, 190 may be separated by a distance D. In use, distance D is greater than the depth or thickness of the covering 52 received therein so that spaces exist between interior surfaces 170,190 of the light blocking device 50 and the window side of the covering 52 and the room side of the covering 52, respectively. In this manner, the light blocking device 150 is spaced from, and does not contact the covering 52, thus minimizing wear on the covering 52. In addition, because of the spaces formed between the interior surfaces 170, 190 of the light blocking device 50 and the interior surfaces 170, 190 of the covering 52, air flow is enabled between the window side of the covering 52 and the room side of the covering 52. By enabling air flow between the window side of the covering 52 and the room side of the covering 52, the air flow assists in counteracting potential air expansion between the covering 52 and the window (typically on warm days) as a result of the insulative properties of the covering 52.

One or both of the interior surfaces 170, 190 of the rear and front channel members 160, 180 may include a light absorbing surface 200. In use, the light absorbing surface 200 acts to absorb, refract, reflect, or break-up (herein "absorb" for the sake of convenience without intent to limit) the light that may be transmitted through gaps between the rear channel member 160 and the front channel member 180, and the covering 52 of the architectural-structure covering 50. In use, the entire interior surface of the U-shaped channel 152 may be covered by the light absorbing surface 200. Alternatively, only a portion of the interior surface of the U-shaped channel 152 may be covered by the light absorbing surface 200.

Collectively, the rear and front channel members 160, 180 and the light absorbing inner surfaces 200 act to minimize the amount of light passage therethrough or reflected therefrom. In one non-limiting example, the light absorbing inner surfaces 200 may have a substantially flat black coloration. A substantially flat black coloration means nearly black or a dark shade of a color that is dark enough to absorb a substantial portion of incident light, such that the surface is substantially non-reflective. The light absorbing inner surface 200 may be formed in any manner now known or hereafter developed. For example, the light absorbing inner surfaces 200 may be formed by a layer such as a tape, fabric, flocking, anti-reflective coating, or paint coating. Alternatively, light absorbing inner surface 200 may be formed as a co-extruded (dark) layer with side channel, resulting in the side channel being one color and the light absorbing inner surfaces being another color. In another example, the light absorbing inner surfaces 200 may be formed by a thermal alteration of a surface of the channel, e.g., blackening by heating or burning.

In another example, the light absorbing inner surfaces 200 may be formed by a texturing of a surface of the channel 152. That is, as will be described in greater detail below in connection with FIGS. 12 and 13), the light absorbing surfaces 200 may include a plurality of serrations or projections 402 formed thereon. As illustratively represented in FIG. 12, the plurality of serrations or projections 402 facilitate to reflect light away from room. In one embodiment, each serration 402 includes a first surface 404 and a second surface 406 terminating in a tip 408. As such, the first surface 404 is in the form of an angled surface (i.e., forming an oblique angle with respect to the inner surface 200). The second surface 404 may also be in the form of an angled surface (i.e., forming an oblique angle with respect to the inner surface 200). Alternatively, the second surface 404 may be substantially perpendicular with respect to the inner surface 200. In some embodiments, the tip 408 may be as sharp and pointed (e.g., non-rounded) as manufacturing tolerances will permit. In this manner, the serrations 402 produce the smallest reflection point. However, the tip 408 may be rounded, if desired.

One or both of the rear and front channel members 160, 180 may also include a light blocking strip (not shown) to further assist in preventing light leakage. As will be described in greater detail below, the light blocking strip serves to block light from passing between the interior side surfaces 62 of the window frame 60 and the light blocking device 150. In one embodiment, the light blocking strips may be received within one or more grooves formed in the front and rear channel members 160, 180.

As previously described, the light blocking device 150 may include a projection 154 for engaging with the mounting extrusion 130. Referring to FIGS. 3 and 5, the rear channel member 160 may include first and second projections 154*a*, 154*b* extending from the exterior surface of the base member 162 for coupling with the mounting extrusion 130. The first and second projections 154*a*, 154*b* preferably include a plurality of serrations 156 so that the first and second arms 154*a*, 154*b* can be incrementally positioned with respect to the mounting extrusion 130. In this manner, the user can incrementally adjust the position of the light blocking device 150 with respect to the window frame 60. As such, the user is better able to position the light blocking device 150 to accommodate non-square (e.g., out-of-skew) window frames.

In one example embodiment, the plurality of serrations 156 formed on the first and second projections 154*a*, 154*b* extending from the light blocking device 150 enable approximately one-quarter inch adjustment. In this manner, the perimeter light blockout system 100 can accommodate approximately one-half inch adjustment for out of square windows. Alternatively, instead of using interconnecting arms and projections to form a ratchet-type connection, the light blocking device may be coupled to the mounting extrusion via an adjustable screw-type mechanism. It will be appreciated that these dimensions are merely examples, and that other adjustment magnitudes can be achieved using the disclosed mounting extrusion.

Figure 6:
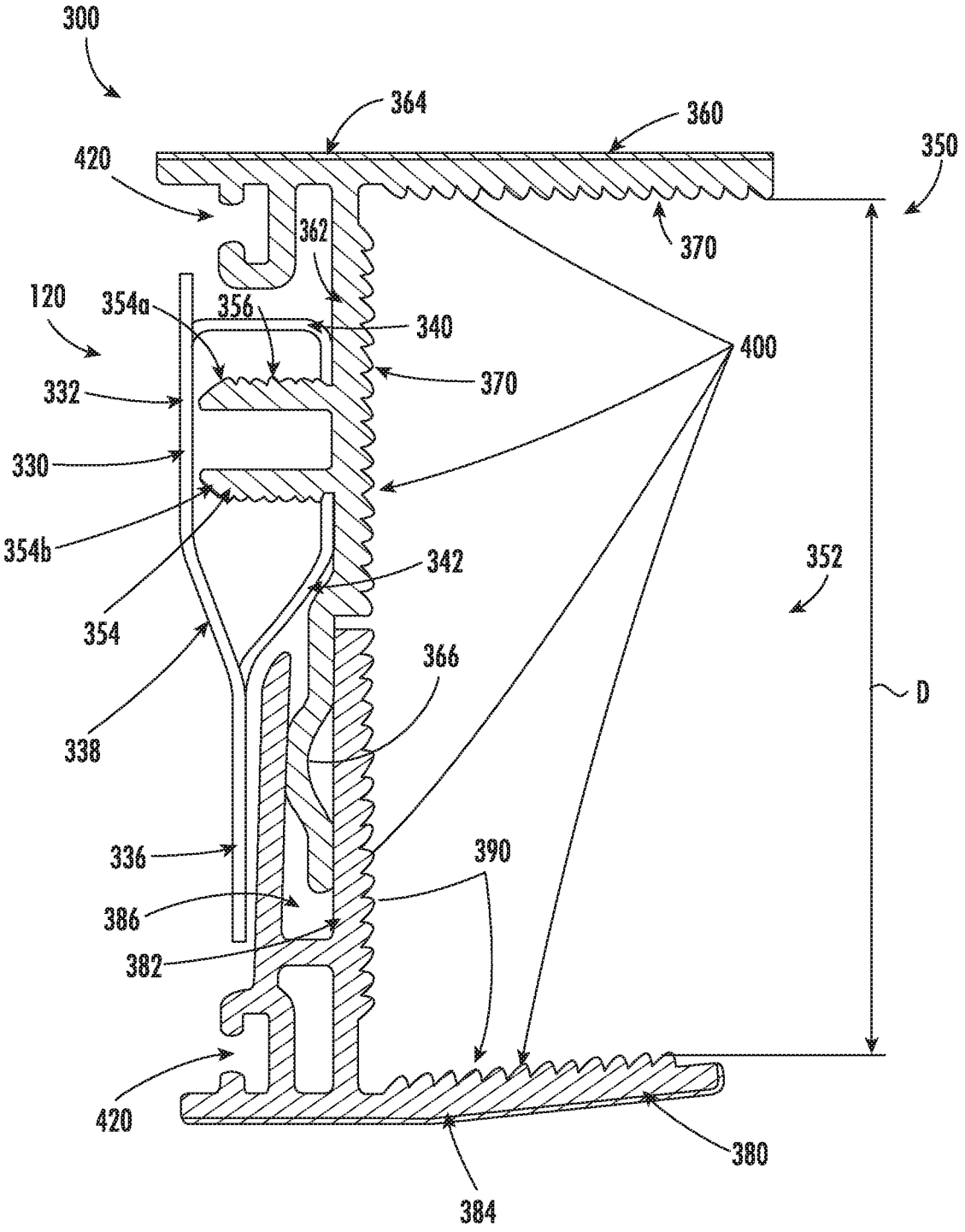
FIG. 6 is a cross-section view of an alternate example of an embodiment of a perimeter light blockout system.
Figure 7:
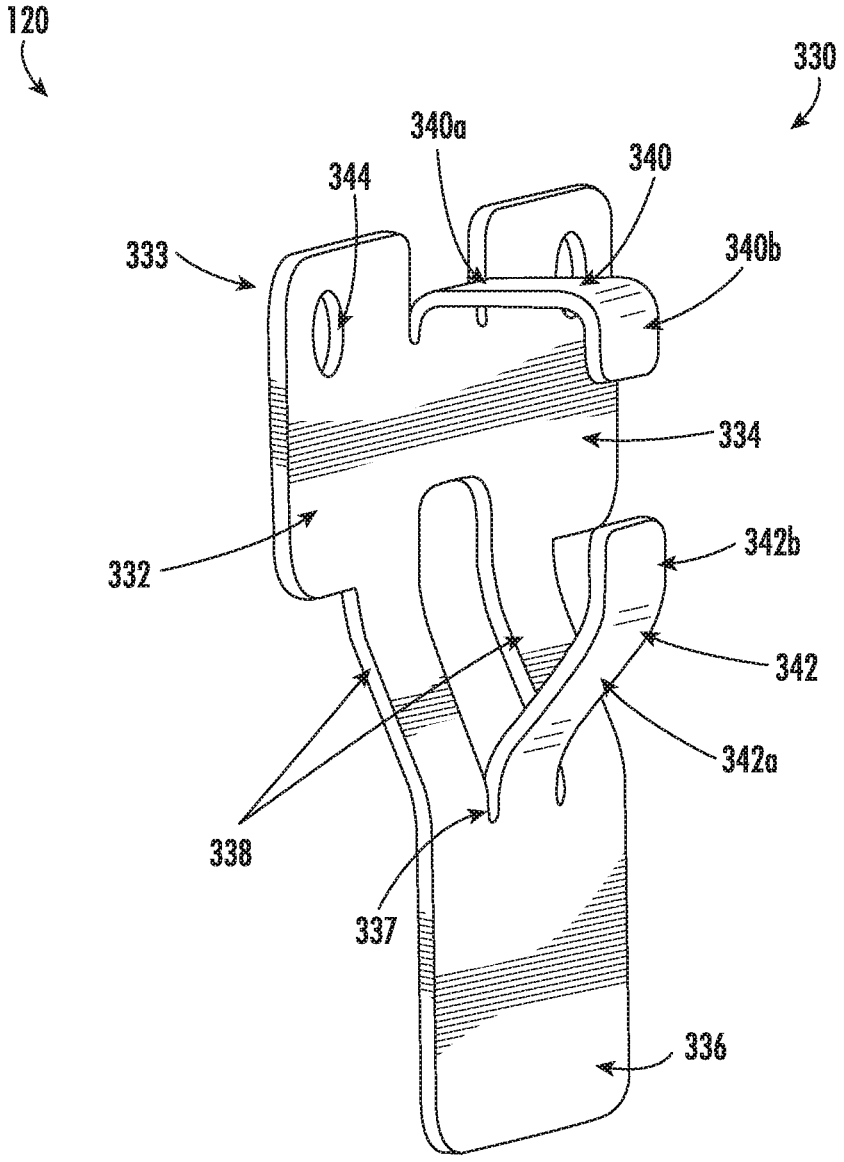
FIG. 7 is a perspective view of an illustrative clip used to couple the light blocking device shown in FIG. 6 to a window frame.
Figure 8:
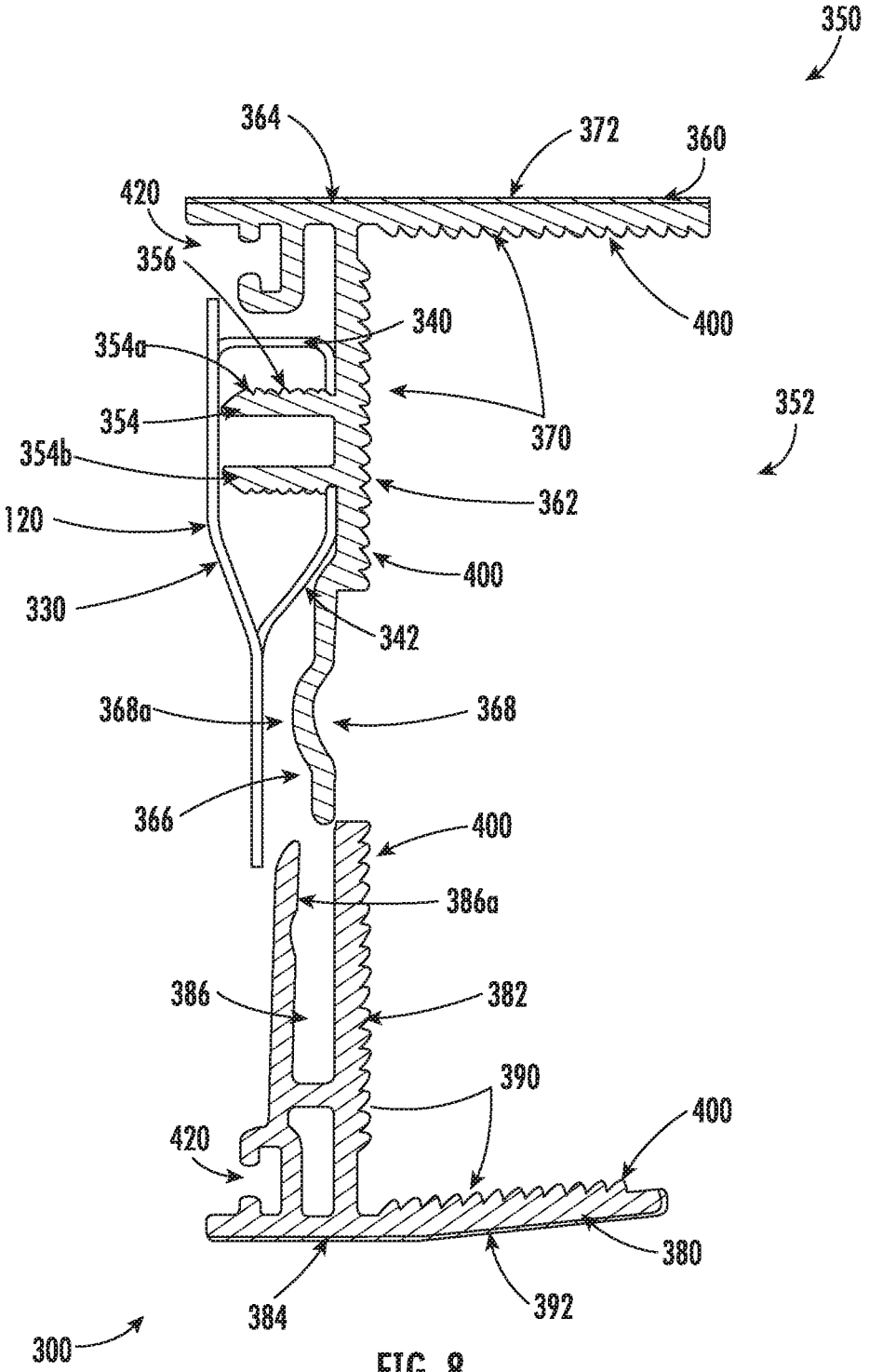
FIG. 8 is an alternate cross-section view of the perimeter light blockout system shown in FIG. 6.

Referring to FIGS. 6-10, a second embodiment of a perimeter light blockout system 300 in accordance with an illustrative, non-limiting embodiment of the present disclosure is shown. The second embodiment is substantially identical to the first embodiment described above except as will be described herein. Referring to FIGS. 6, 7, and 8, in this embodiment, the mounting element 120 are in the form of one or more clips 330 for releasably coupling the light blocking member 350 to the window frame 60. Specifically, in one embodiment, the clips 330 removably mount the light blocking device 350 to the interior side surface 62 of the window frame 60 so that the light blocking device 350 can be easily removed as desired. In one embodiment, the clips 330 include a base member 332 having a window frame coupling surface 333 and a light blocking member surface opposite thereof 334. The window frame coupling surface 333 may be in the form of a planar surface for contacting the interior side surface 62 of the window frame 60. In use, the clips 330 may be coupled to window frame 60 by any coupling mechanism known, including, but not limited to, fasteners. For example, the base member 332 may include one or more holes 344 or other features for receiving fasteners (not shown) for coupling the clips 330 to the window frame 60. The holes 344 may be slotted to enable additional lateral adjustability.

In the embodiment of FIGS. 6, 7, and 8, the clip 330 includes a tab member 336, the tab member 336 may be coupled to the base member 332 by one or more bridge members 338. In use, the bridge members 338 enable the tab member 336 to flex or move with respect to the base member 332 for reasons that will become apparent. In addition, in the embodiment of FIGS. 6, 7, and 8, the clip 330 includes first and second upstanding arms 340, 342 for engaging a portion of the light blocking device 350. The first upstanding arm 340 may include a first portion 340*a* that extends generally perpendicular with respect to the light blocking member surface 334 and a second portion 340*b* that extends generally perpendicular with respect to the first portion 340*a*. Similarly, the tab member 336 may include a second upstanding arm 342. As shown, the second upstanding arm 342 extends from a front portion 337 of the tab member 336. The second upstanding arm 342 includes a first portion 342*a* that extends laterally towards the first upstanding arm 340 and a second portion 342*b* that extends generally coplanar with the second portion 340*b* of the first upstanding arm 340.

The first upstanding arm 340 may be integrally formed with the base member. Alternatively, the first upstanding arm 340 may be coupled to the base member 332 by any means now known or hereafter developed, including, but not limited to, an adhesive, welding, fasteners, etc. Similarly, the second upstanding arm 342 may be integrally formed with the tab member 336. Alternatively, the second upstanding arm 342 may be coupled to the tab member 336 by any means now known or hereafter developed, including, but not limited to, an adhesive, welding, fasteners, etc.

As will be described in greater detail below, the first and second arms 340, 342 may be configured to receive a projection 354 formed on or connected to the light blocking device 350. Preferably, the projection 354 includes a plurality of serrations 356 formed thereon so that the first and second arms 340, 342 may incrementally engage the projection 354, similar to a ratchet-type connection. In this manner, by incrementally adjusting the position of the projection 354 with respect to the arms 340, 342, the user can adjust the position of the light blocking device 350 with respect to the window frame 60 to assist with proper alignment of the light blocking device 350, for example, with respect to an out-of-skew window frame 60. In addition, by incorporating clips 330, the process of coupling the light blocking device 350 is substantially hands free (e.g., no need for extra tools, such as, a wrench, a screwdriver, etc., to tighten; the user just presses the light blocking device 350 into contact with the clips 330).

Referring to FIG. 7, the tab member 336 may lie in a plane that is not coplanar with a plane of the window frame coupling surface 333 of the base member 332. In this manner, the connection of tab member 336 and the bridge members 338 to the base member 332 enable the clip 330 to act as a spring clip so that applying a force to the tab member 336 causes the second arm 342 to move with respect to (e.g., away from) the first arm 340 to release the light blocking device 350 therefrom. That is, for example, the clip 330 may be arranged so that applying a force against the tab member 336 of the clip 330 (e.g., pressing the tab member 336 towards the interior surface 62 of the window frame 60), causes the first and second arms 340, 342 to move away from each other so that the light blocking device 350 can be decoupled from the mounting element 320. As best shown in FIG. 6 and as will be described in greater detail below, the light blocking device 350 may include a rear channel member 360 and a front channel member 380, the tab member 336 preferably extends longitudinally beyond the front edge of the rear channel member 360 of the light blocking device 350 so that a user can access the tab member 336 of the clip 330 even after the rear channel member 360 has been coupled to the clips 330 so that the user can readily compress the tab member 336 towards the interior side surface 62 of the window frame 60 to release the rear channel member 360.

While the clips 330 have been illustrated, and described as being used for coupling the light blocking device 350 to the window frame 60, it is envisioned that the clips 330 may be used in other applications, for example, for mounting a decorative element or trim piece, mounting a headrail or a bottom rail of the architectural-structure covering to the window frame, mounting a frame element for a skylight, etc.

Referring to FIGS. 6 and 8, the illustrated light blocking device 350 includes a channel 352 for receiving a portion (e.g., sides) of the covering 52 of the architectural-structure covering 50 therein. As shown, the light blocking device 350 may be in the form of a U-shaped channel. In one embodiment, the light blocking device 350 includes a rear (e.g., window side) channel member 360 and a front (e.g., room side) channel member 380. In the example embodiment shown, the rear and front channel members 360, 380 each have an approximate L-shape so that when the front channel member 380 is coupled to the rear channel member 360, the light blocking device 350 has an approximate U-shaped channel 352 for receiving a portion of the covering 52 of the architectural-structure covering (e.g., shade) 50 therein. The U-shaped channel 352 may be sized and shaped so as not to contact the covering 52 received therein as the covering 52 moves from between the extended and retracted positions.

The rear channel member 360 may include a base member 362 that when installed extends generally parallel to the interior side surface 62 of the window frame 60 and a rear wall portion 364 that extends generally perpendicular from the base member 362. Similarly, the front channel member 380 includes a base member 382 that when installed extends generally parallel to the interior side surface 62 of the window frame 60 and a front wall portion 384 that extends generally away from the base member 382. As shown, the front wall portion 384 of the front channel member 380 may initially extend perpendicularly from the base member 382. However, the front wall portion 384 may be angled inwardly towards the rear channel member 360. However, it should be understood that the front wall portion 384 may have any profile to provide alternative aesthetic appearances. In this manner, the end portion of the covering 52 may reside within the U-shaped channel 352. As such, the rear wall portion 364 of the rear channel member 360 and the front wall portion 384 of the front channel member 380 may extend beyond (e.g., overlap with) the end portions of the covering 52 of the architectural-structure covering 50, and hence, extend across the light gap formed between the sides of the covering 52 and the interior side surfaces 62 of the window frame 60, and thus prevent light from seeping through.

The front and rear channel members 360, 380 may be coupled to each other by any means now known or later developed. As shown in FIGS. 6 and 8-10, the base member 382 of the front channel member 380 may include an internal recess 386 for receiving a longitudinally extending portion or stem 366 formed on the rear channel member 360. The longitudinally extending portion or stem 366 may be integrally formed with the base member 362 of the rear channel member 360. In this manner, the user may slidably couple the front channel member 360 to the rear channel member 380. That is, the longitudinally extending portion or stem portion 366 may be slidably received within the internal recess 386 formed in the base member 382 of the front channel member 380. Referring to FIG. 8, the longitudinally extending portion or stem 366 may include a detent 368, either coupled thereto or integrally formed into the stem portion 366, so that the front channel member 380 is positively coupled to the rear channel member 360, thereby minimizing the possibility that the front channel member 380 may become inadvertently disengaged from or shift (e.g., move) with respect to the rear channel member 360. As shown, the detent 368 may be in the form of a flexible, arcuate curved surface 368*a* that is configured to contact an inner surface 386*a* of the internal recess 386 so that upon insertion, the arcuate curved surface 368*a* contacts and compresses against the inner surface 386*a* of the internal recess 386, so that the front channel member 380 is positively frictionally coupled to the rear channel member 360. Alternatively, the front channel member 380 may be additionally coupled to the rear channel member 360 by any other means now known or later developed. As will be appreciated by one of ordinary skill in the art, the internal recess 386 and the longitudinally extending portion or stem portion 366 may be interchangeable. That is, the front channel member 380 may include the longitudinally extending portion or stem 366 while the rear channel member 360 may include the internal recess 386.

Each of the rear and front channel members 360, 380 includes an interior surface 370, 390 (e.g., surface that faces the covering 52 of the architectural-structure covering 50) and exterior surface 372, 392 (e.g., surface opposite the inter surface). As previously mentioned, the U-shaped channel 352 may be sized and shaped so as not to contact the covering 52 received therein (e.g., portions (e.g., sides) of the covering 52 received between the interior surfaces 370, 390 of the light blocking device 350) as the covering 52 moves from between the extended and retracted positions. That is, as illustrated in FIG. 6, the interior surface 370 of the rear wall portion 364 of the rear channel member 360 and the interior surface 390 of the front wall portion 384 of the front channel member 380 may be separated by a distance D. In use, distance D is greater than the depth or thickness of the covering 52 received therein so that spaces exist between interior surfaces 370, 390 of the light blocking device 350 and the window side of the covering 52 and the room side of the covering 52, respectively. In this manner, the light blocking device 350 is spaced from, and does not contact the covering 52, such configuration may minimize wear on the covering 52. In addition, because of the spaces formed between the interior surfaces 370, 390 of the light blocking device 50 and the interior surfaces 370, 390 of the covering 52, air flow is enabled between the window side of the covering 52 and the room side of the covering 52. Air flow between the window side of the covering 52 and the room side of the covering 52 may assist in counteracting potential air expansion between the covering 52 and the window (typically on warm days) as a result of the insulative properties of the covering 52.

Similar to the embodiment described above in connection with FIGS. 2-5, one or both of the interior surfaces 370, 390 of the rear and front channel members 360, 380 may include a light absorbing surface 400. In use, the light absorbing surface 400 acts to absorb the light that may be transmitted through gaps between the rear channel member 360 and the front channel member 380, and the covering 52 of the architectural-structure covering 50. In use, the light absorbing surface 400 operates substantially identical as previously described above and thus further discussion is omitted for the sake of brevity.

One or both of the rear and front channel members 360, 380 may also include a light blocking strip (not shown) to further assist in preventing light leakage. The light blocking strip may be in the form of a light tube or a light blocking strip of material, such as, a strip of light-blocking bristles, a strip made from a variety of natural or synthetic materials (similar to weather stripping), a strip made from a woven or non-woven textile material, and/or a strip made from a flexible material that can be easily deflected and compressed, etc. The light blocking strip may be a single strip of material or a plurality of strips arranged together.

As shown, the light blocking strip may be received in a groove 420 formed in the rear channel member 360 and the front channel member 380 to prevent light leakage between the window frame 60 and the light blocking device 350. In use, the light blocking strip may be coupled to the rear and front channel members 360, 380 by feeding, pressing, or forming the light blocking strip into the groove 420. In use, the light blocking strips serve to block light from passing between the interior side surfaces 62 of the window frame 60 and the light blocking device 350.

Figure 9:
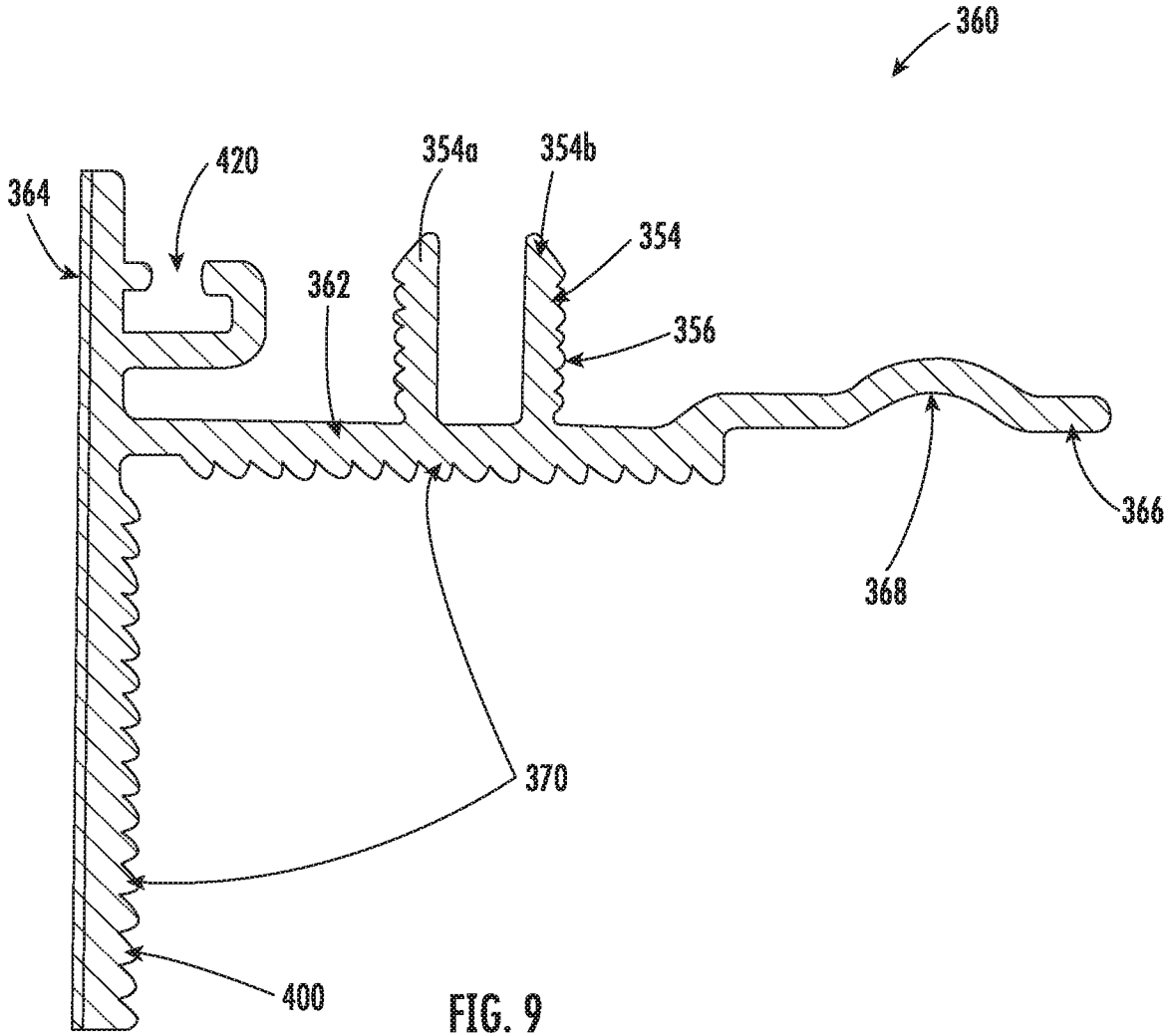
FIG. 9 is a cross-section view of a rear channel member used in connection with the perimeter light blockout system shown in FIG. 6.
Figure 10:
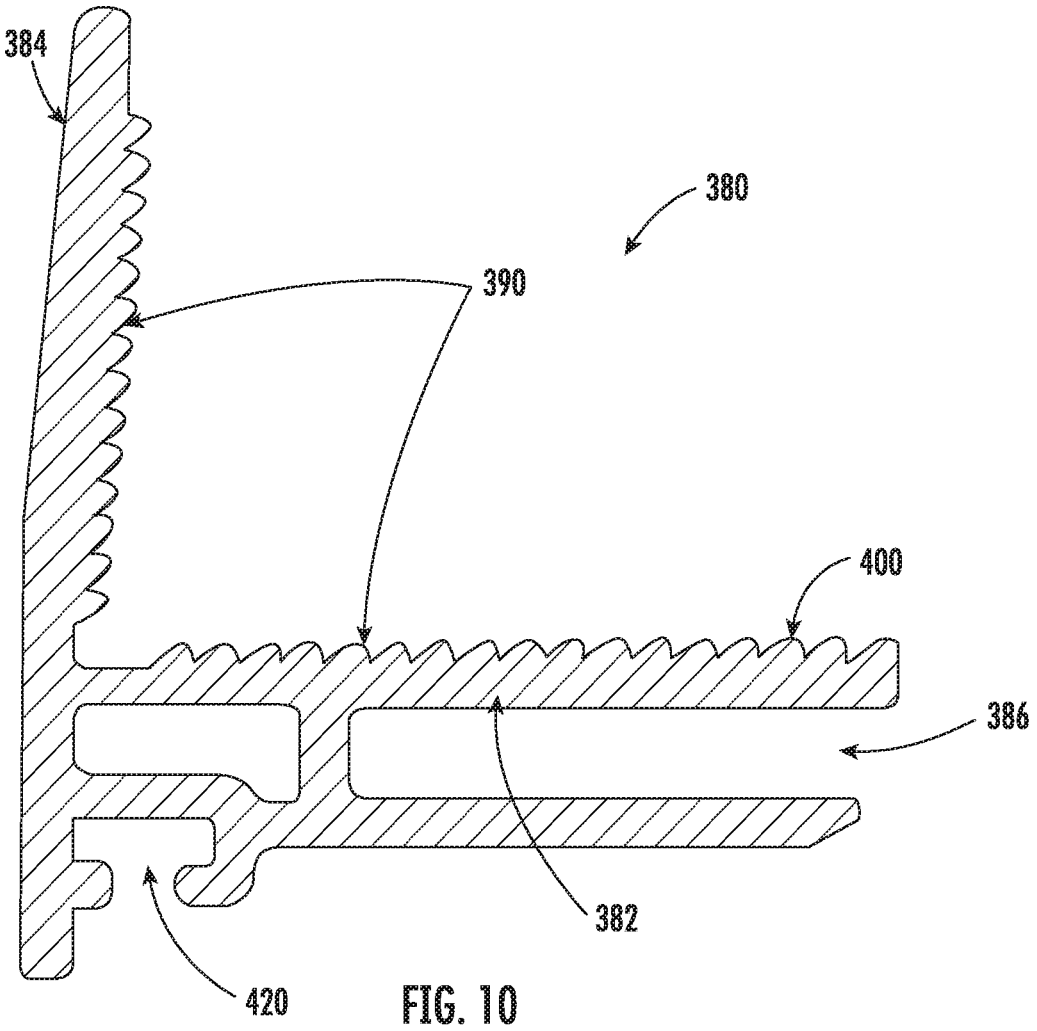
FIG. 10 is a cross-section view of a front channel member used in connection with the perimeter light blockout system shown in FIG. 6.

Similar to the embodiment described above in connection with FIGS. 2-5, and as previously described, the light blocking device may include a projection 354 for engaging with the mounting clips 330. Referring to FIGS. 6, 8 and 9, in the illustrative embodiment, the rear channel member 360 includes first and second projections 354*a*, 354*b* extending from the exterior surface of the base member 362 for coupling with the mounting clips 330. The first and second projections 354*a*, 354*b* preferably include a plurality of serrations 356 so that the first and second arms 354*a*, 354*b* can be incrementally positioned with respect to the mounting clips 330. In this manner, the user can incrementally adjust the position of the light blocking device 350 with respect to the window frame 60. As such, the user is better able to position the light blocking device 350 to accommodate non-square (e.g., out-of-skew) window frames. For example, in connection with a non-square window frame 60, the user may be able to fully insert the projection 354 into the upper mounting clip 330 while incrementally retracting the projection 354 from the lower mounting clip 330.

In one example embodiment, similar to the embodiment described above in connection with FIGS. 2-5, the plurality of serrations 356 formed on the first and second projections 354*a*, 354*b* extending from the light blocking device 350 enable approximately one-quarter inch adjustment. In this manner, the perimeter light blockout system 300 can accommodate approximately one-half inch adjustment for out of square windows. Alternatively, instead of using interconnecting arms and projections to form a ratchet-type connection, the light blocking device may be coupled to the clips via an adjustable screw-type mechanism. It will be appreciated that these dimensions are merely examples, and that other adjustment magnitudes can be achieved using the disclosed clips. In one embodiment, the mounting clip 330 may include outwardly projecting arms 354*a*, 354*b* that have non-uniform lengths so that the user can also tilt the light blocking device with respect to the window frame.

Figure 11:
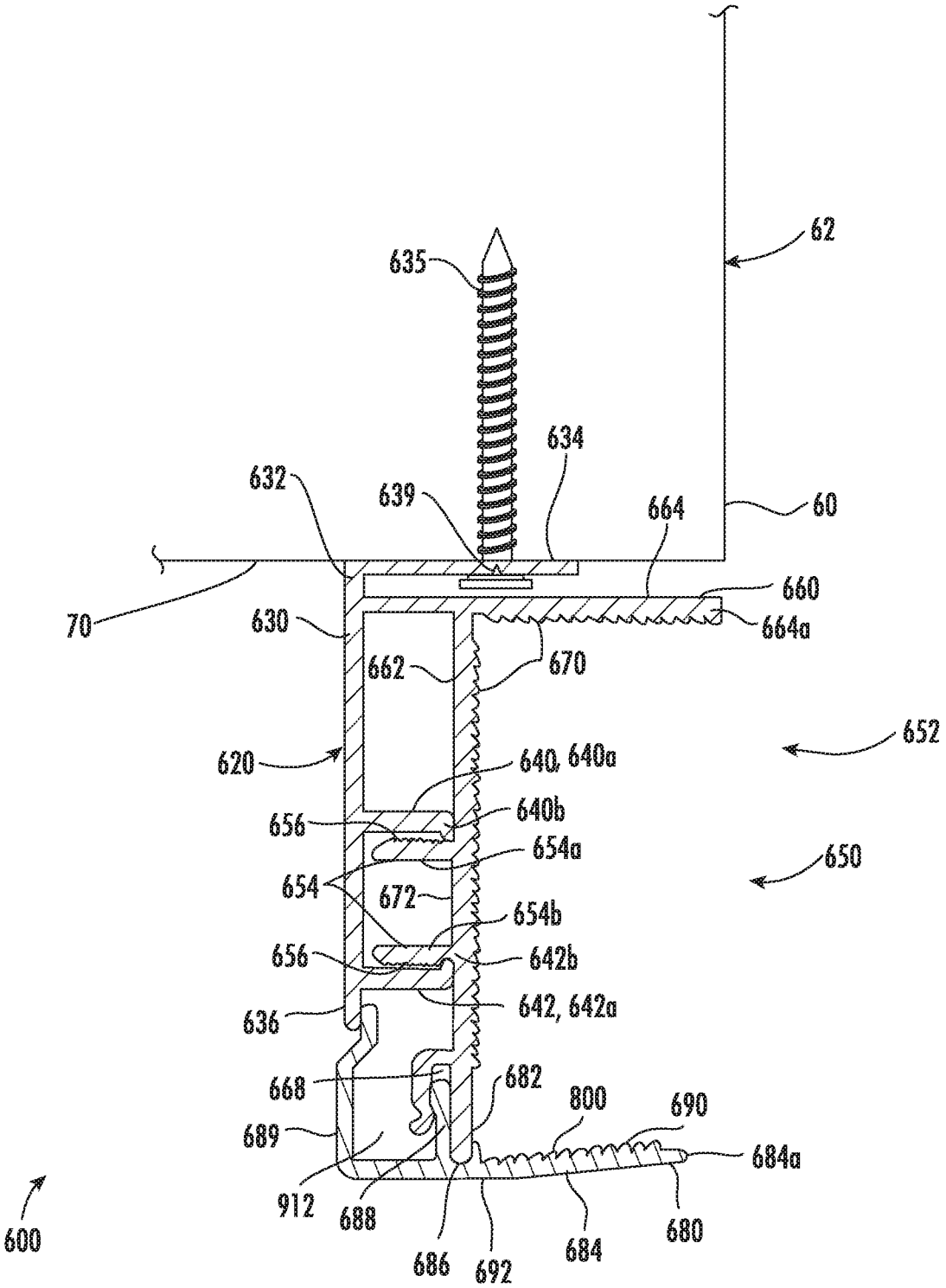
FIG. 11 is a cross-section view of an alternate example of an embodiment of a perimeter light blockout system.

Referring to FIG. 11, a third embodiment a perimeter light blockout system 600 in accordance with an illustrative, non-limiting embodiment of the present disclosure is shown. The third embodiment is similar to the first and second embodiments of the perimeter light blockout system 100, 300 described above. However, the third embodiment of the perimeter light blockout system 600 is particularly well suited for mounting outside a window frame. That is, for example, the architectural-structure covering 50 may be mounted to an interior wall or surface above, for example, a window opening. In this embodiment, the sides of the architectural-structure covering 50 may extend laterally beyond the interior side surfaces 62 of the window frame 60. As such, in use, the lateral width of the architectural-structure covering 50 is greater than the lateral width of the window opening as measured between the interior side surfaces 62 of the window frame 60. Thus, light gaps may generally exist and extend along and between the architectural-structure covering 50 of the covering 52 and the outer surface of the interior wall 70, for example, the front facing wall surface of the window frame. Thus, it is desirable to provide a light blocking mechanism 600 for occupying the existing light gaps and obstructing light from passing through the light gaps and into the room. Alternatively, it is envisioned that the perimeter light blockout system 600 may be mounted to the interior side surfaces 62 of the window frame 60 by, for example, removing the first portion 634 of the base member 632. In one embodiment, the first portion 634 may include a weakened portion so that, if needed, the first portion 634 could be more easily removed (e.g., snapped off) to facilitate mounting to the interior side surfaces 62 of the window frame 60.

Referring to FIG. 11, the perimeter light blockout system 600 generally includes a mounting element 620 and a light blocking device 650. The mounting element 620, in use, may couple the light blocking device 650 to the interior wall 70 adjacent to the window frame 60. In one embodiment, the mounting element 620 may be a mounting extrusion 630 for releasably coupling the light blocking member 650 to the outer surface of the interior wall 70. The mounting extrusion 630 may include a base member 632. In the embodiment illustrated in FIG. 11, the base member 632 includes first and second portions 634, 636. In use, the first portion 634 is configured for contacting the outer surface of the interior wall 70. The first portion 634 may be in the form of a planar surface for contacting the outer surface of the interior wall 70. The second portion 636 is configured to extend away from the interior wall 70. As such, the base member 632 may be considered to have an L-shape, although other shapes are envisioned. For example, as previously mentioned, it is envisioned that the perimeter light blockout system 600 may be mounted to the interior side surfaces 62 of the window frame 60 by, for example, removing the first portion 634 of the base member 632 from the mounting element 620, and then securing the mounting element 620 to the interior side surface 62 via one or more fasteners 635.

In use, the mounting extrusion 630 may be coupled to the outer surface of the interior wall 70 by any coupling mechanism known including, but not limited to, adhesive strips, two-face backing tape, Velcro, magnetics, etc. In one embodiment, the base member 632 may include one or more holes (not shown) or other features for receiving fasteners 635 for coupling the mounting extrusion 630 to the outer surface of the interior wall 70. The holes may be slotted to enable additional lateral adjustability. In one embodiment, the mounting extrusion 630 may extend the entire height of the window frame. In this manner, the mounting extrusion 630 helps to prevent or minimize the amount of light seeping through the gap formed between the covering 52 and the outer surface of the interior wall 70.

FIG. 11 shows that the second portion 636 of the mounting extrusion 630 may include first and second upstanding arms 640, 642 for engaging a portion of the light blocking device 650. Similar to the embodiments described above, for example, in connection with FIGS. 2-5, the first and second upstanding arms 640, 642 may include a first portion 640*a*, 642*a*, respectively, and a second portion 640*b*, 642*b*, respectively, that extends generally perpendicular with respect to the first portion 640*a*, 642*a*, respectively. The first and second upstanding arms 640, 642 may be integrally formed with the base member 632. Alternatively, the first and second upstanding arms 640, 642 may be coupled to the base member 632 by any means now known or hereafter developed, including, but not limited to, an adhesive, welding, fasteners, etc.

In use, the first and second arms 640, 642 may be configured to receive a projection 654 formed on or connected to the light blocking device 650. In one embodiment, the projection 654 includes a plurality of serrations 656 formed thereon so that the first and second arms 640, 642 may incrementally engage the projection 654, similar to a ratchet-type connection. In this manner, by incrementally adjusting the position of the projection 654 with respect to the arms 640, 642, the user can adjust the position of the light blocking device 650 with respect to the outer surface of the interior wall 70 (or the interior side surface 62 of the window frame 60 if used as an inside mount) to assist with proper alignment of the light blocking device 650. In addition, by incorporating the mounting extrusion 630, the process of coupling the light blocking device 650 is substantially hands free (e.g., no need for extra tools, such as, a wrench, a screwdriver, etc., to tighten; user just presses the light blocking device 650 into contact with the mounting extrusion 630).

In use, after the mounting extrusion 630 has been coupled to the outer surface of the interior wall 70 via, for example, one or more fasteners 635, the light blocking device 650 may be coupled to the mounting extrusion 630. For example, the projection 654 formed on or connected to the light blocking device 650 may be coupled to the first and second arms 640, 642 formed on or extending from the mounting extrusion 630. In one embodiment, the second portions 640*b*, 642*b* of the first and second arms 640, 642 may ratchetably couple to the plurality of serrations 656 formed on the projection 654 formed on or connected to the light blocking device 650.

In use, applying a force to the light blocking device 650 causes the first and second arms 640, 642 to move (e.g., separate) with respect to each other. In this manner, the light blocking device 650 may be couplable to, and removable from, the mounting extrusion 630. That is, for example, the first and second arms 640, 642 of the mounting extrusion 630 may be arranged so that applying a compressive force against the light blocking device 650 (e.g., pressing the light blocking device 650 against the mounting extrusion 630 with the projection 654 located between the first and second arms 640, 642), causes the first and second arms 640, 642 to move away from each other so that the light blocking device 650 can be coupled to the mounting extrusion 630. Similarly, applying a pulling force to the light blocking device 650, causes the first and second arms 640, 642 to move away from each other so that the light blocking device 650 can be decoupled from the mounting extrusion 630.

Referring to FIG. 11, the base member 632 may include a flexible portion 639 such as, for example, a groove formed in the first portion 634 of the base member 632. The flexible portion 639, in use, allows the base member 632 to conform to the outer surface of the interior wall 70. That is, initially, the flexible portion (e.g., groove) 639 may act as a locating groove to assist the installer to center a drill and screw when installing the mounting extrusion 630 to the outer surface of the interior wall 70. In addition, the flexible portion 639 allows for surfaces of the base member 632 on opposite sides of the flexible portion 639 to angle away from the main body portion to ensure enhanced surface area contact between the mounting extrusion 630 and the outer surface of the interior wall 70, thus enabling a tighter light seal with the outer surface of the interior wall 70.

Similar to the embodiments described above, for example, in connection with FIGS. 2-5, the light blocking device 650 includes a channel 652 for receiving a portion (e.g., sides) of the covering 52 of the architectural-structure covering 50 therein. As shown, the light blocking device 650 may be in the form of a U-shaped channel. The U-shaped channel 652 may be sized and shaped so as not to contact the covering 52 received therein as the covering 52 moves from between the extended and retracted positions. Preferably, the light blocking device 650 may include a rear channel member (e.g., wall side) 660 and a front channel member (e.g., room side) 680, although it is envisioned that the lighting block device 650 could be integrally made, or made from more components or members.

Similar to the embodiments shown above, the rear and front channel members 660, 680 may each have an approximate L-shape so that when the front channel member 680 is coupled to the rear channel member 660, the light blocking device 650 has an approximate U-shaped channel 652 for receiving the architectural-structure covering (e.g., shade) therein. That is, the rear channel member 660 includes a base member 662 that when installed extends generally perpendicular to the outer surface of the interior wall 70 and a rear wall portion 664 that extends generally perpendicular from the base member 662 (e.g., generally parallel to the outer surface of the interior wall 70). In use, the outermost edge 664*a* of the rear wall portion 664 may be installed so that it substantially aligns with the interior side surface 62 of the window frame 60.

Similarly, the front channel member 680 includes a base member 682 that, when installed, extends generally perpendicular to the outer surface of the interior wall 70, and a front wall portion 684 that extends generally away from the base member 682. As previously mentioned, the front wall portion 684 of the front channel member 680 may initially extend perpendicularly from the base member 682. It will be appreciated that the front wall portion 684 may, however, in some example embodiments, be angled inwardly towards the rear channel member 660. However, it should be understood that the front wall portion 684 may have any profile to provide alternative aesthetic appearances. In this manner, the end portion of the covering 52 may reside within the U-shaped channel 652. As such, the rear wall portion 664 of the rear channel member 660 and the front wall portion 684 of the front channel member 680 may extend beyond (e.g., overlap with) the end portions of the covering 52 of the architectural-structure covering 50 to prevent light from seeping between the end of the covering 52 and the interior surface of the U-shaped channel 652.

The front and rear channel members 680, 660 may be coupled to each other by any means now known or later developed. Referring to FIG. 11, in one embodiment, the base member 662 of the rear channel member 660 may extend entirely from the rear wall portion 664 to the front wall portion 684. As such, the base member 682 of the front channel member 680 may include an internal recess 686 for receiving the base member 662 of the rear channel member 660. In addition, as shown, the front channel member 680 may include a longitudinally extending portion or stem 688 extending from the front channel member 680. The rear channel member 660, such as, for example, the base member 662, may include an internal recess 668 for receiving the longitudinally extending portion or stem 688 extending from the front channel member 680. In this manner, the user may slidably couple the front channel member 680 to the rear channel member 660. That is, the base member 662 of the rear channel member 660 may be slidably received within the internal recess 686 of the front channel member 680, and the longitudinally extending portion or stem portion 688 may be slidably received within the internal recess 668 of the rear channel member 660. Additionally, and/or alternatively, the front channel member 680 may include a rear surface projection 689 for coupling with the mounting extrusion 630. In this manner, the perimeter light blockout system 600 may have a pleasing aesthetic appearance.

The longitudinally extending portion or stem 688 of the front channel member 680 and/or the end of the base member 662 of the rear channel member 660 may include a detent, either coupled thereto or integrally formed therewith, so that the front channel member 680 is positively coupled to the rear channel member 660, thus minimizing the possibility that the front channel member 680 may become inadvertently disengaged from or shift (e.g., move) with respect to the rear channel member 660. Alternatively, the front channel member 680 may be additionally coupled to the rear channel member 660 by any other means now known or later developed. As will be appreciated by one of ordinary skill in the art, the internal recesses and the longitudinally extending portion or stem portion may be interchangeable.

Each of the rear and front channel members 660, 680 may include an interior surface 670, 690 (e.g., surface that faces the covering 52 of the architectural-structure covering 50) and an exterior surface 672, 692 (e.g., surface opposite the interior surface). Similar to the embodiments described above, the U-shaped channel 652 may be sized and shaped so as not to contact the covering 52 received therein (e.g., portions (e.g., sides) of the covering 52 received between the interior surfaces 670, 690 of the light blocking device 650)

as the covering 52 moves between the extended and retracted positions. In this manner, the light blocking device 650 is spaced from, and does not contact the covering 52, such configuration may minimize wear on the covering 52. In addition, air flow is enabled between the window side of the covering 52 and the room side of the covering 52.

The exterior surfaces 692 of the front channel member 680 and the exterior surface 635 of the mounting extrusion 630 may include a finished outer surface so that, in use, the perimeter light blockout system 600, and specifically, the visible exterior surfaces have a pleasing aesthetic appearance.

Figure 12:
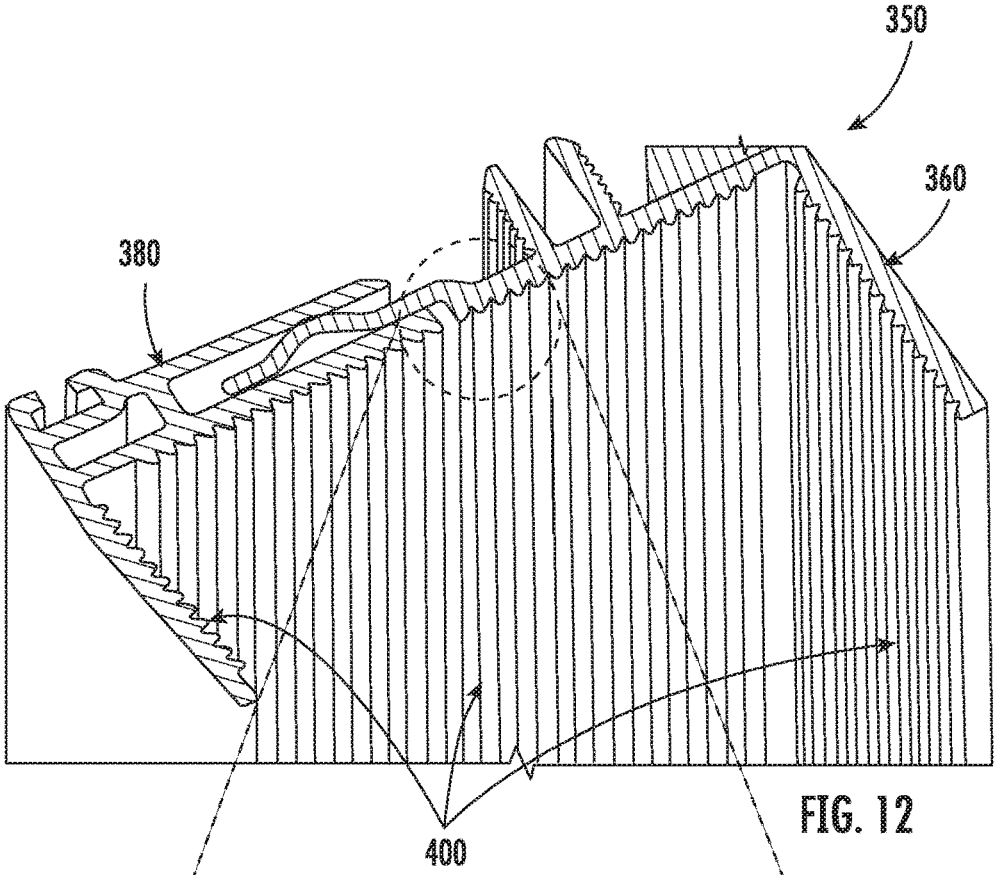
FIG. 12 is a top perspective view illustrating an example of an embodiment of a light absorbing surface formed on the rear channel member and the front channel member.
Figure 13:
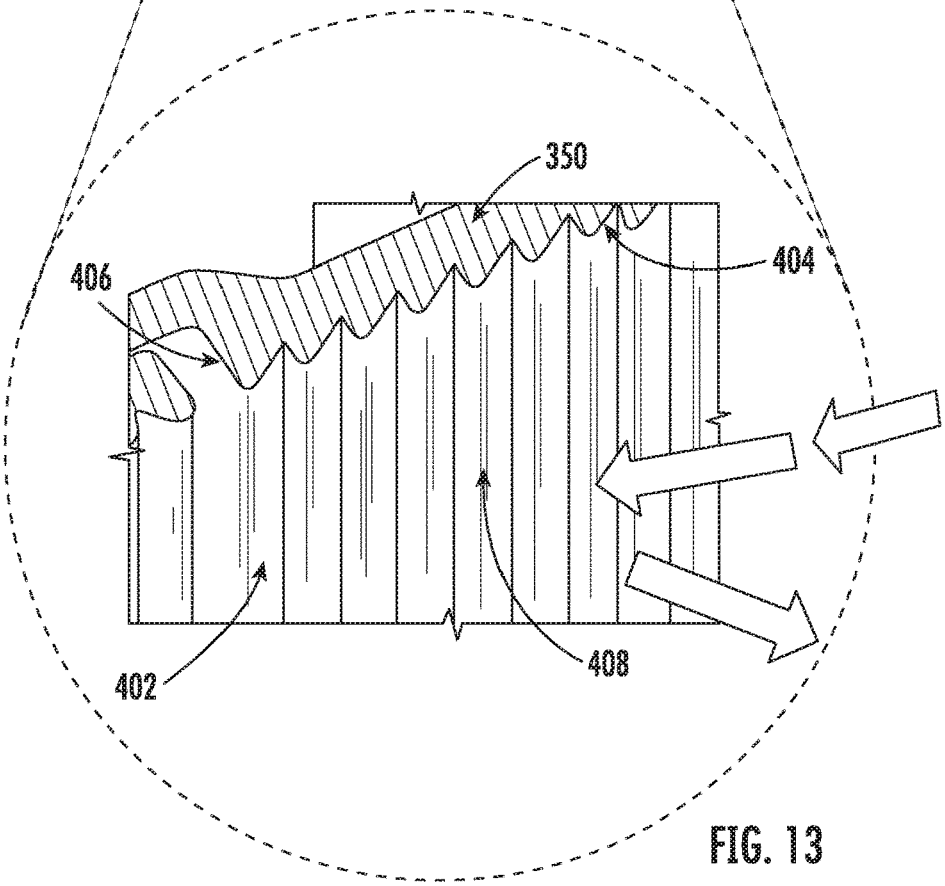
FIG. 13 is a detailed view of the light absorbing surface taken from FIG. 12.

Similar to the embodiments described above, and as previously described in greater detail in connection with FIGS. 12 and 13, one or both of the interior surfaces 670, 690 of the rear and front channel members 660, 680 may include a light absorbing surface 800. In use, the light absorbing surface 800 acts to absorb the light that may be transmitted through gaps between the rear channel member 660 and the front channel member 680, and the covering 52 of the architectural-structure covering 50. In use, the light absorbing surface 400 operates substantially identical as previously described above and thus further discussion is omitted for the sake of brevity.

Similar to the embodiments described above, the light blocking device 650 may include a projection 654 for engaging with the mounting extrusion 630. The rear channel member 660 may include first and second projections 654*a*, 654*b* extending from the exterior surface of the base member 662 for coupling with the mounting extrusion 630. The first and second projections 654*a*, 654*b* preferably include a plurality of serrations 656 so that the first and second arms 654*a*, 654*b* can be incrementally positioned with respect to the mounting extrusion 630. In this manner, the user can incrementally adjust the position of the light blocking device 650 with respect to the outer surface of the interior wall 70.

Figure 14:
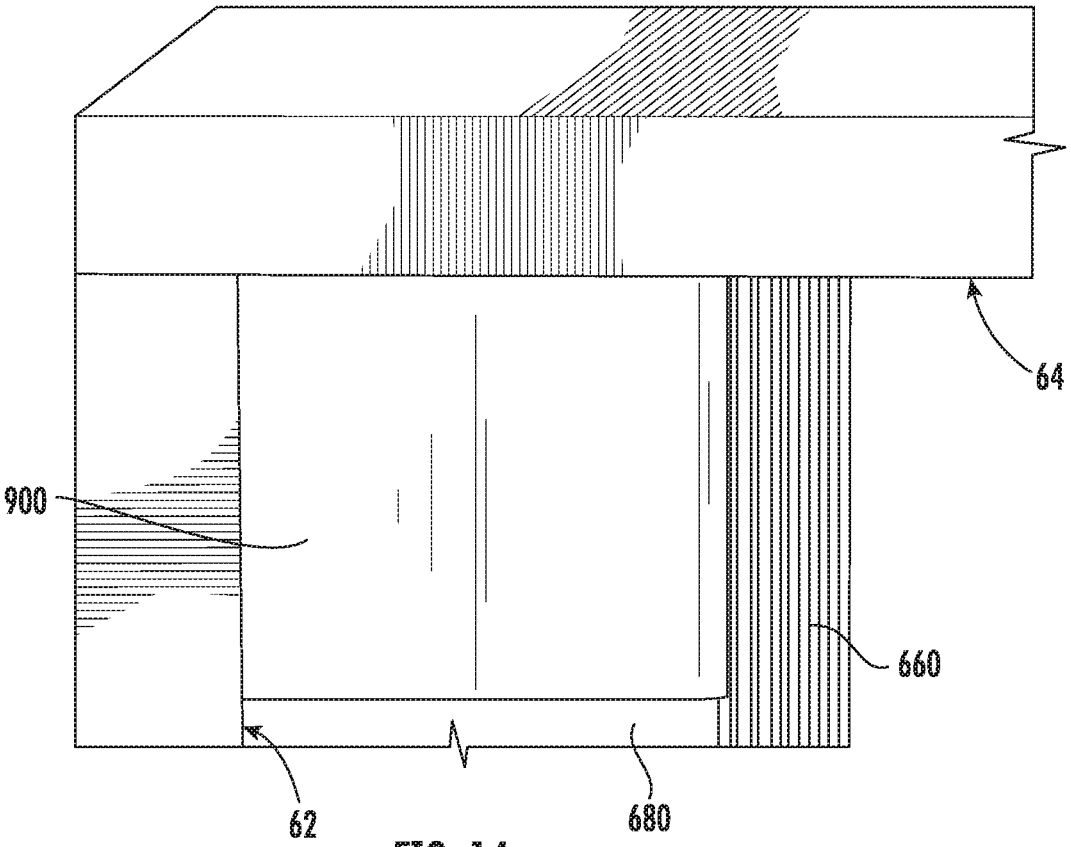
FIG. 14 is a detailed top perspective view of an example of an embodiment of a cap used in connection with a perimeter light blockout system.
Figure 15:
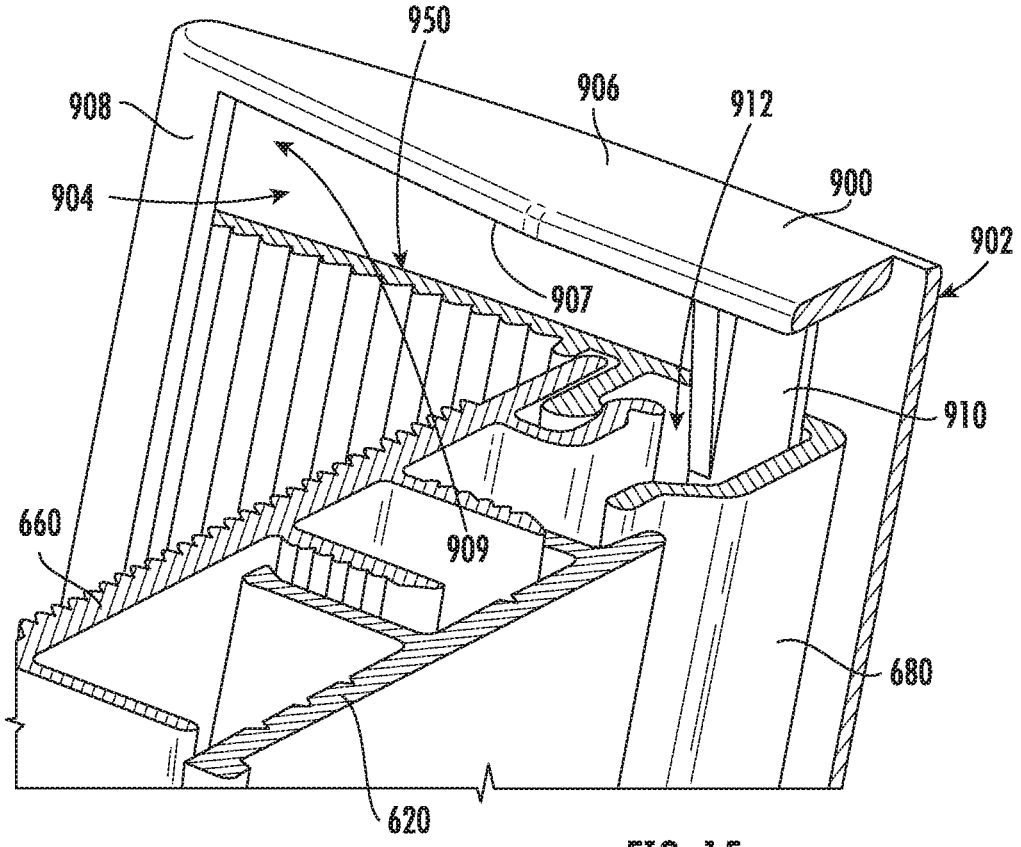
FIG. 15 is a detailed, partially exploded view of the cap and perimeter light blockout system shown in FIG. 14.
Figure 16:
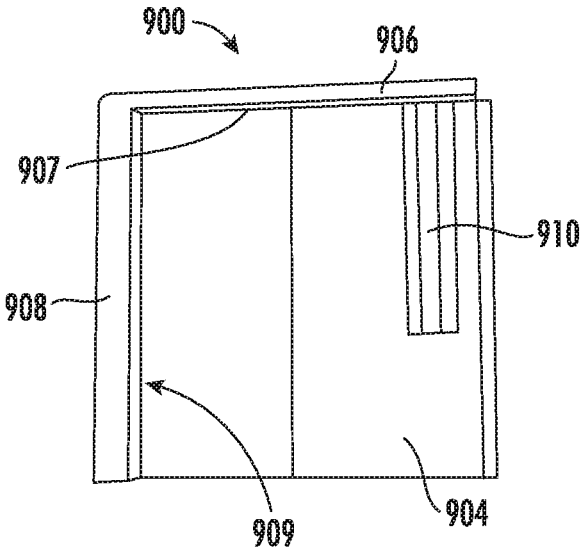
FIG. 16 is a rear view of the cap shown in FIG. 14.

Referring to FIGS. 14-16, in one embodiment, the perimeter light blockout system may also incorporate a cap 900 coupled to the light blocking device 650. In use, the cap 900 may be adjustably positioned with respect to the light blocking device 650 to prevent any light seeping through a gap formed between, for example, the top edge 950 of the light blocking device 650 and the top edge 64 of the window frame 60. Such gaps can occur when the dimensions of one or more components of the light blocking device 650 do not conform to the exact dimensions of the window frame 60. It should be understood that while the cap 900 is described and illustrated in connection with perimeter light blockout system 600, and specifically with an interior mounted perimeter light blockout system 600, the cap 900 may be used in connection with any perimeter light blockout system including perimeter light blockout systems 100, 300 and in connection with an exterior mounted perimeter light blockout system 600 to prevent light seepage between the top edge of the light blocking device and the headrail of the architectural-structure covering.

The cap 900 may include an exterior surface 902, an interior surface 904, and a top surface 906. The interior and exterior surfaces 904, 902 of the cap 900 may substantially correspond with the shape of the light blocking device 650, and more specifically with the shape of the front channel member 680. In use, the cap 900 may be coupled to the light blocking device by any means now known or hereafter developed, including for example, a friction-fit connection. Referring to FIGS. 15 and 16, in one embodiment, the cap 900 may include a projection 910 extending downwardly from an inner surface 907 of the top surface 906 of the cap 900. In use, the projection 910 may be sized and configured to be received within an opening 912 formed in the light blocking device 650, more specifically, within the front channel member 680. In this manner, the cap 900 may be slidably positioned with respect to the light blocking device 650 so that the location of the cap 900 may be adjusted to close any gap between the top edge 950 of the light blocking device 650 and the top edge 64 of the window frame 60. Additionally, and/or alternatively, the cap 900 may also include a curved front edge 908 forming a recess 909 for coupling with a front edge of the light blocking device 650, and more specifically with a front edge 684*a* of the front channel member 684 for providing additional coupling of the cap 900 to the front channel member 680.

Figure 18:
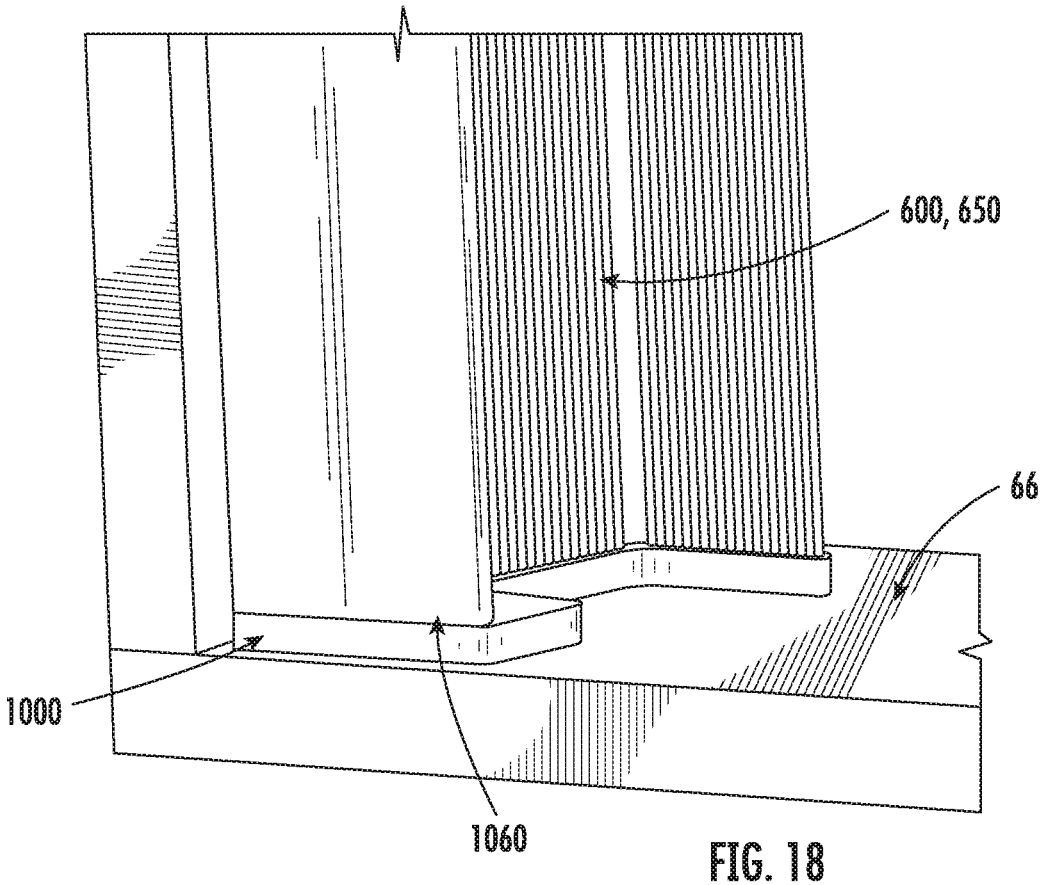
FIG. 18 is a detailed view of the cap shown in FIG. 17 coupled to a bottom portion of a perimeter light blockout system; the perimeter light blockout system shown installed within a window frame.
Figure 19:
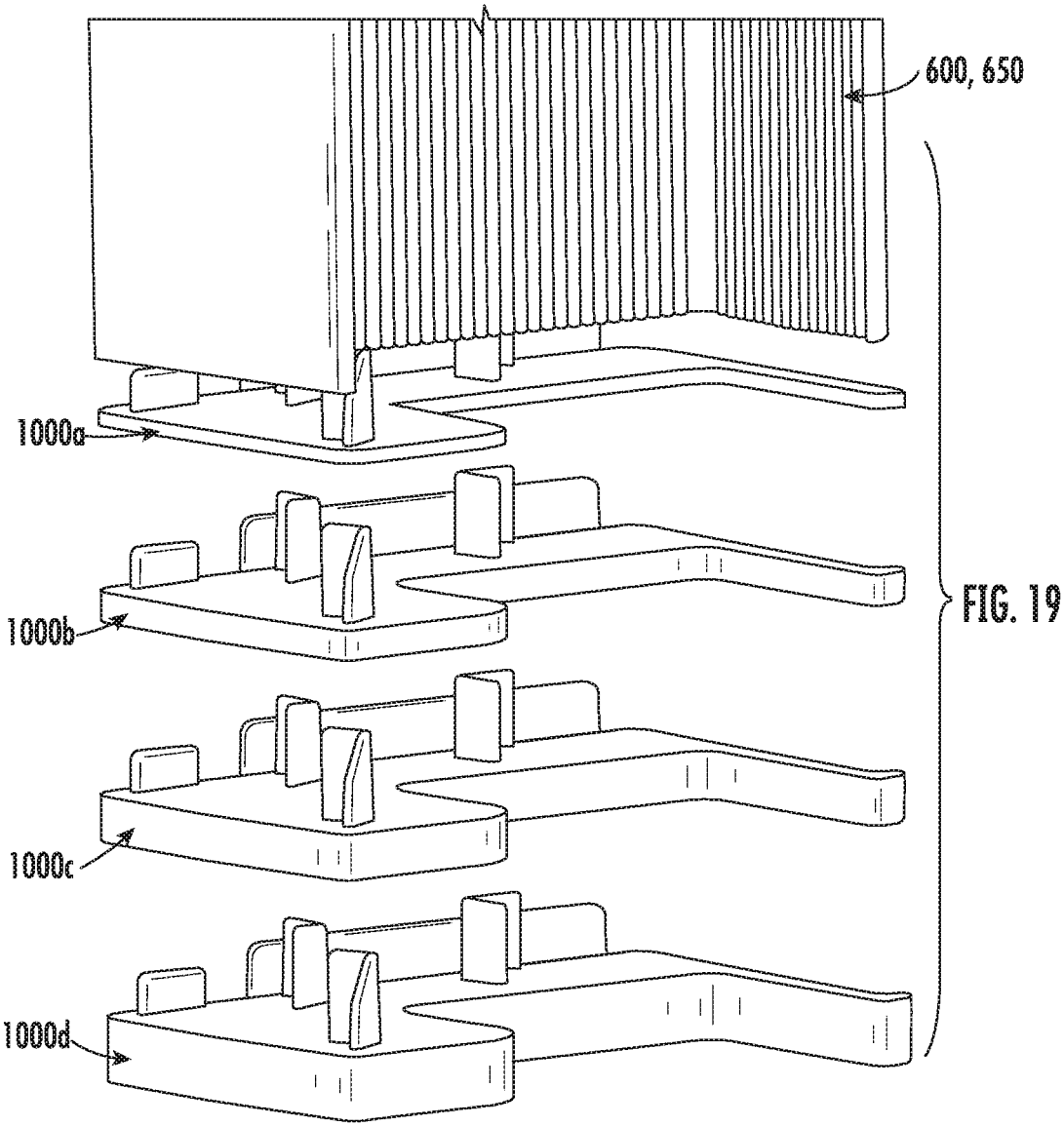
FIG. 19 is a detailed, exploded view of the cap shown in FIG. 17, FIG. 19 illustrating multiple different caps of varying thickness.

Referring to FIGS. 17-19, in another embodiment, the perimeter light blockout system may incorporate a cap 1000 coupled to the light blocking device 650. In use, the cap 1000 may be coupled to the top and bottom edges 1050, 1060 of the light blocking device 650 to prevent any light seeping through a gap formed between, for example, the top edge 1050 of the light blocking device 650 and the top edge 64 of the window frame 60, and/or the bottom edge 1060 of the light blocking device 650 and the bottom edge 66 of the window frame 60. Such gaps can occur when the dimensions of one or more components of the light blocking device 650 do not conform to the exact dimensions of the window frame 60. It should be understood that while the cap 1000 is described and illustrated in connection with perimeter light blockout system 600, and specifically with an interior mounted perimeter light blockout system 600, the cap 1000 may be used in connection with any perimeter light blockout system including perimeter light blockout systems 100, 300 and in connection with an exterior mounted perimeter light blockout system 600 to prevent light seepage between the top and bottom edges of the light blocking device and the window frame or headrail of the architectural-structure covering.

The cap 1000 may include an outer surface 1002 and an inner surface 1004. As shown, the inner and outer surfaces 1002, 1004 of the cap 1000 may have a shape that substantially corresponds with the shape of the light blocking device 650, although it is envisioned that other shapes may be used, such as, for example, a rectangular shape. In use, the cap 1000 may be coupled to the light blocking device 650 by any means now known or hereafter developed. Referring to FIGS. 17 and 19, in one embodiment, the cap 1000 may include one or more projections 1006 extending from the inner surface 1004 of the cap 1000. In use, the projections 1006 may be sized and configured to be received within opening or spaces 1008 formed in the light blocking device 650.

Contrary to the embodiment of the cap 900 described above in connection with FIGS. 14-16, the cap 1000 of the present embodiment is not slidably positioned with respect to the light blocking device 650. Rather, the cap 1000 of the present embodiments includes a fixed thickness for coupling to the top and bottom edges 1050, 1060 of the light blocking device 650. Referring to FIG. 19, in use, it is envisioned that a plurality of caps 1000 having varying thicknesses may be provided, for example, in a kit. In this manner, based on the size of the existing gap between the top and bottom edges 1050, 1060 of the light blocking device 650 and the top and bottom edges 64, 66 of the window frame 60 an appropriate sized cap 1000 can be selected.

In one embodiment, it is envisioned that a plurality or kit of end caps 1000*a*, 1000*b*, 1000*c*, 1000*d* may be provided with varying thicknesses ranging from, for example, 1/16" to ¼", although these dimensions are merely exemplary and other thicknesses may be used. For example, caps 1000*a-d* may be provided in thicknesses of, for example, 1/16" (1.6 mm), ⅛" (3.2 mm), 3/16" (4.8 mm), and ¼" (6.4 mm).

By providing a plurality of caps 1000 with varying thicknesses, an installer can select the best-fitting cap 1000 for their particular application. In this manner, the system can accommodate measurement discrepancies in the height of the light-blocking device, architectural-structure covering and/or windows where, for example, one side may be longer than the other. Moreover, the system can create a tight-fit between the top and bottom edges 1050, 1060 of the light-blocking device 650 and the top and bottom edges 64, 66 of the window frame 60 thereby preventing light from seeping through and providing a nicer aesthetic finish. In use, while it is envisioned that top and bottom caps 1000 may be provided on the top and bottom edges 1050, 1060 of the light blocking device, respectively, it is envisioned that a single cap 1000 may only be used on the top edge or the bottom edge. In addition, it is envisioned that some or all of the measurement discrepancies may be accommodated by either the top cap, bottom cap, or both.

Figure 20:
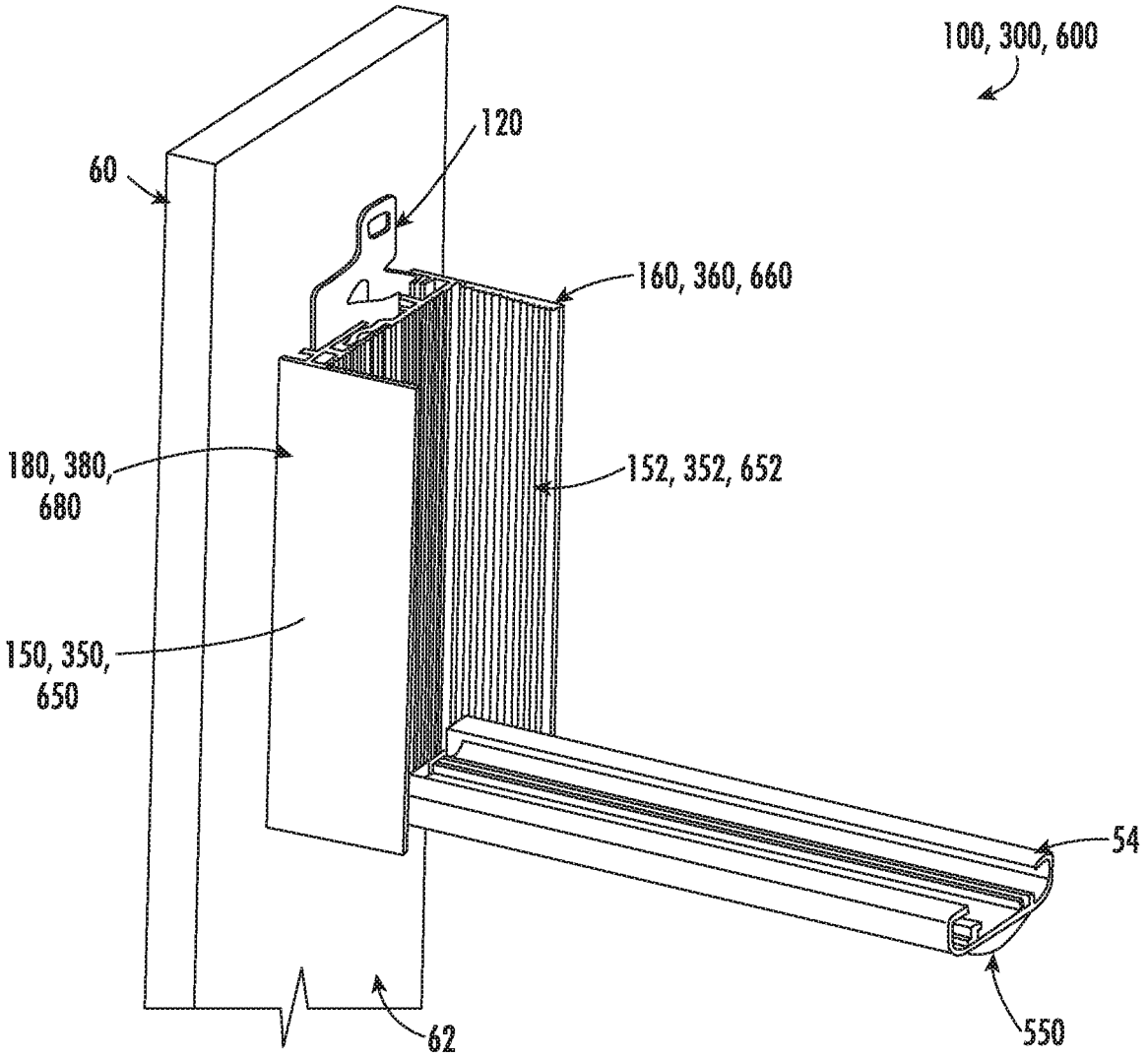
FIG. 20 is a partial, perspective view illustrating an example of an embodiment of a bottom rail light blocking mechanism that may be used in connection with a perimeter light blockout system as described herein, the bottom rail light blocking mechanism being coupled to the bottom rail of the architectural-structure covering.
Figure 21:
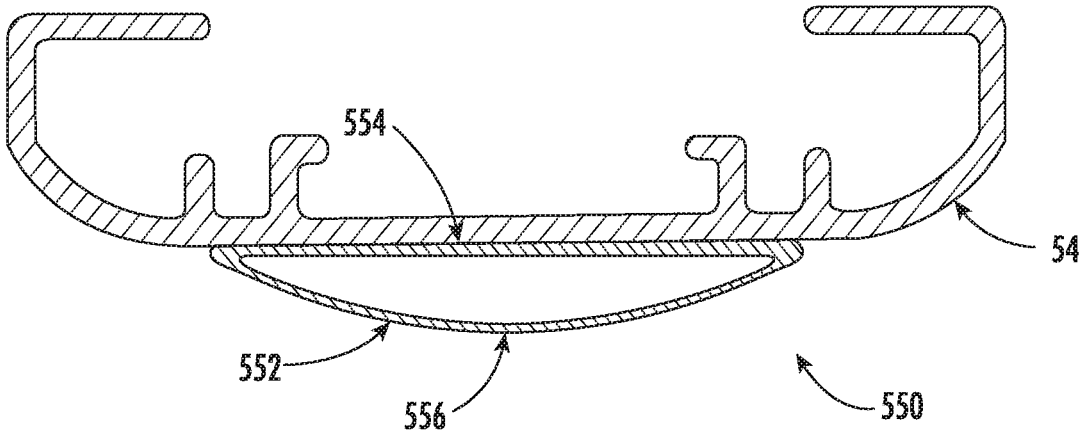
FIG. 21 is a cross-section of the illustrative bottom rail light blocking mechanism shown in FIG. 20.

Referring to FIGS. 20 and 21, in one embodiment, the perimeter light blockout system 100, 300, 600 may also incorporate a longitudinal light blocking mechanism 550 for coupling to the bottom rail 54 of the architectural-structure covering 50 (not shown in FIG. 20 for purposes of clarity) so that, in the fully extended position, the bottom rail light blocking mechanism 550 may interact with the interior bottom surface of the window frame for preventing light from passing through the bottom rail 54 of the architectural-structure covering 50 and the bottom surface of the window frame. Referring to FIG. 21, the bottom rail light blocking mechanism 550 may be a semi-circular flexible member 552 having a substantially planar top surface 554 for coupling to the bottom surface of the bottom rail 54 of the architectural-structure covering 50. The bottom rail light blocking mechanism 550 may include a flexible dome 556 so that in the fully extended position, the flexible dome 556 contacts the bottom window sill to minimize or eliminate unwanted light entry. The flexible dome 556 of the bottom rail light blocking mechanism 550 may be configured to deform under the compression force of contacting the window sill to further assist with minimizing or preventing unwanted light entry.

In use, the bottom rail light blocking mechanism 550 may be coupled to the bottom rail 54 of the architectural-structure covering 50 by any mechanism now known or later developed including, for example, an adhesive, a fastener, Velcro, magnets, etc. In addition, one of ordinary skill in the art will appreciate that while the bottom rail light blocking mechanism 550 has been described as being affixed to the bottom rail 54 of the architectural-structure covering 50 for movably contacting the bottom window sill, the bottom rail light blocking mechanism 550 may be affixed to the bottom window sill for contacting the bottom rail 54 of the architectural-structure covering 50.

Figure 22:
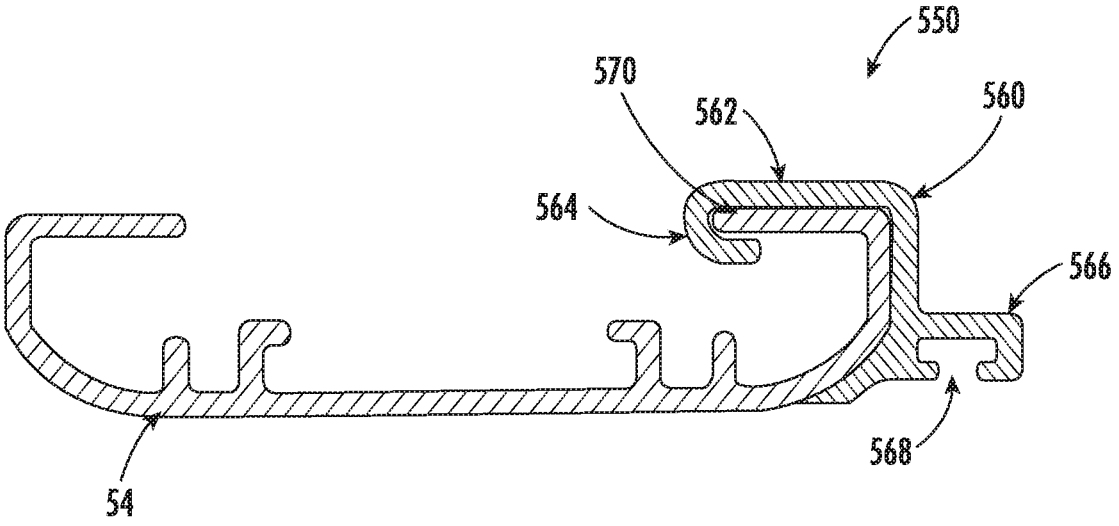
FIG. 22 is a cross-section of an alternate, illustrative bottom rail light blocking mechanism that may be used in connection with a perimeter light blockout system as described herein.

Alternatively, referring to FIG. 22, the bottom rail light blocking mechanism 550 may be in the form of a clip 560 for engaging the bottom rail 54 of the architectural-structure covering 50. The bottom rail light blocking mechanism 550 includes a laterally extending arm 562 and hook 564 for engaging the bottom rail 54 of the architectural-structure covering 50. The bottom rail light blocking mechanism 550 may also include a rearward extending projection 566 and recess 568 for receiving a light blocking strip as previously described. In use, the hook 564 is hooked onto a lip 570 of the bottom rail 54 and then rotated into final position (as shown in FIG. 22).

Figure 23:
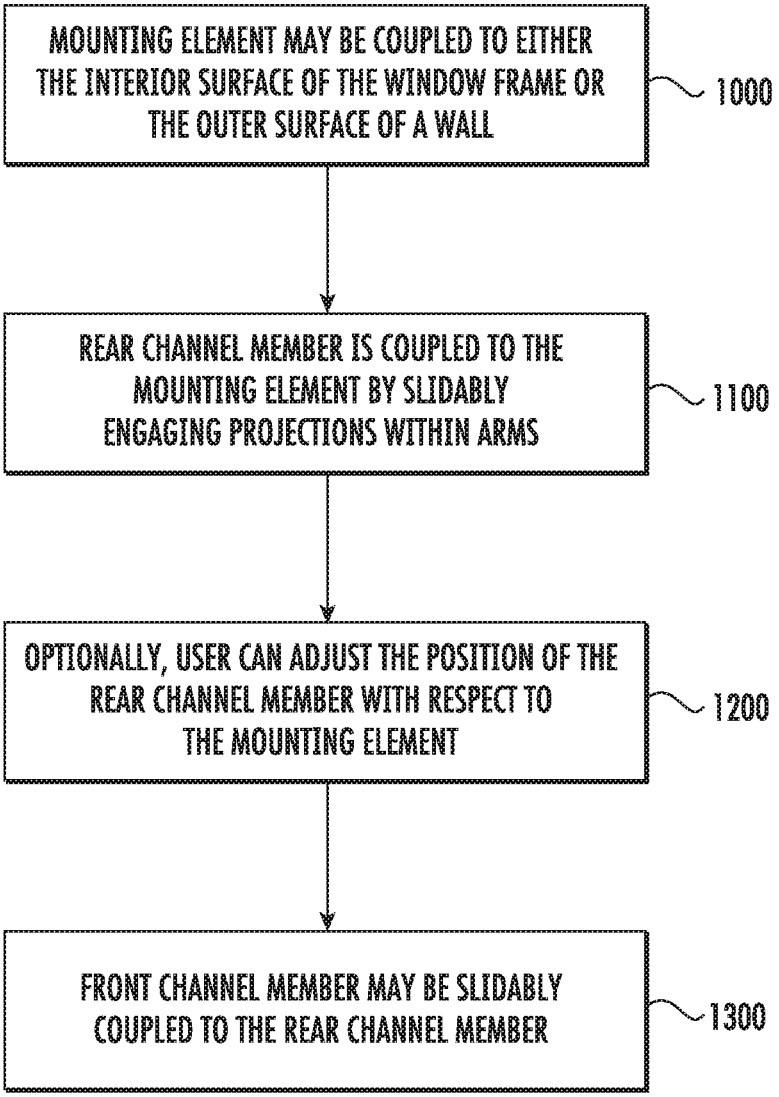
FIG. 23 is an illustrative installation method for installing a perimeter light blockout system.

Referring to FIG. 23, an illustrative installation method will now be described. At 1000, mounting element 120 is coupled to the interior side surface 62 of the window frame 60 or the outer surface of the interior wall 70 depending on whether the covering and/or perimeter light blockout system is interiorly or exteriorly mounted. At 1100, the rear channel member 160, 360, 660 is coupled to the mounting element 120, 620, such as, for example, by slidably engaging projections 154*a*, 154*b*, 354*a*, 354*b*, 654*a*, 654*b* within the arms 140, 142, 340, 342, 640, 642. At 1200, the user can adjust the position of the rear channel member 160, 360, 660 with respect to the mounting element 120, such as, for example, by adjusting the position of the projections 154*a*, 154*b*, 354*a*, 354*b*, 654*a*, 654*b* within the arms 140, 142, 340, 342, 640, 642 to ensure that the rear channel member 160, 360, 660 is properly aligned regardless of the geometry of the window (e.g., regardless if the window is square or not). At 1300, the front channel member 180, 380, 680 is slidably coupled to the rear channel member 160, 360, 680.

In use, the perimeter light blockout system 100, 300, 600 of the present disclosure substantially minimizes or eliminates any light leakage, for example, between the existing gap between the end of the covering (e.g., shade) and the interior side surface of the window frame, or between the covering and the outer surface of the interior wall. As such, the perimeter light blockout system 100, 300, 600 provides a solution for use in home theater rooms, bedrooms, etc. In addition, the design of the perimeter light blockout system 100, 300, 600 allows it to be installed without requiring the user to replace their existing architectural-structure coverings. As such, the perimeter light blockout system 100, 300, 600 minimizes or prevents light leakage while not altering the basic functionality of the covering, affecting the thermal properties and heat movement past the sides of the shades, etc.

While various embodiments of the perimeter light blockout system having certain features have been described and illustrated, it should be understood that the embodiments should not be so limited and that features may be interchangeable between the various embodiments. For example, while the first and second embodiments of the perimeter blockout system 100, 300 have been described as being for interior mounted systems, one of ordinary skill in the art will appreciate that the systems may be easily modified for exterior mounted systems.

As used herein, an element recited in the singular and proceeded with the word "a" or "an" should be understood as not excluding plural elements, unless such exclusion is explicitly recited. Furthermore, references to "one embodiment" of the present disclosure are not intended to be interpreted as excluding the existence of additional embodiments that also incorporate the recited features. In addition, while components may have been described in connection with one embodiment but not another, one of ordinary skill in the art will appreciate that such components may be interchangeable and used in connection with other embodiments.

While the present disclosure makes reference to certain embodiments, numerous modifications, alterations, and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A perimeter light blockout system for minimizing an amount of light passing between gaps formed between a covering and a surface of a window frame or wall, said system comprising:

a mounting element configured to be mounted to the surface of the window frame or wall; and a light blocking device configured to be coupled to the mounting element;

wherein said mounting element provides a degree of adjustment relative to said light blocking device so that said light blocking device is aligned with an out-of-skew window frame;

wherein said light blocking device includes a rear channel member releasably coupled to a front channel member; said rear and front channel members each have an approximate L-shape so that when said front channel member is directly coupled to said rear channel member, said light blocking device has an approximate U-shaped channel for receiving the covering therein; and wherein said mounting element includes first and second arms for engaging one or more projections extending from said light blocking device.

2. The system of claim 1, wherein said mounting element releasably connects said light blocking device to the surface of the window frame or wall to enable a user to remove all or part of said light blocking device.

3. The system of claim 1, wherein said one or more projections include a plurality of serrations so that said first and second arms are incrementally adjustable with respect to said one or more projections.

4. The system of claim 3, wherein said one or more projections includes first and second projections extending from said light blocking device, said first and second projections engaging said first and second arms, respectively, each of said first and second projections including a plurality of serrations.

5. The system of claim 3, wherein said mounting element is a mounting extrusion for releasably coupling said light blocking device to the surface of the window frame or wall, said mounting extrusion including a base member for contacting the surface of the window frame or wall, and said first and second arms for engaging said one or more projections of said light blocking device.

6. The system of claim 5, wherein the base member includes a flexible portion or groove so that the base member better conforms to the surface of the window frame or wall when coupled thereto.

7. The system of claim 3, wherein said mounting element is one or more clips for releasably coupling said light blocking device to the surface of the window frame or wall, said one or more clips including said first and second arms for engaging said one or more projections of said light blocking device.

8. The system of claim 7, wherein each of said one or more clips include a tab member, applying a force to said tab member causes said first and second arms to move with respect to each other to release said one or more projections extending from said light blocking device so that said light blocking device can be decoupled from said clip.

9. The system of claim 1, wherein said U-shaped channel has a channel depth D, said channel depth D is greater than a depth of the covering so that spaces exist between interior surfaces of said light blocking device and the covering.

10. The system of claim 1, further comprising a bottom rail light blocking mechanism for coupling to a bottom rail of the covering so that, in the fully extended position, said bottom rail light blocking mechanism interacts with an interior bottom surface of the window frame for preventing light from passing between said bottom rail of the covering and the bottom surface of the window frame.

11. The system of claim 10, wherein said bottom rail light blocking mechanism includes a semi-circular flexible dome for contacting the bottom surface of the window frame.

12. The system of claim 11, further comprising a cap coupled to said light blocking device, said cap being adjustably positioned with respect to said light blocking device.

13. The system of claim 12, wherein said cap includes an exterior surface, an interior surface, and a top surface, said interior and exterior surfaces of said cap substantially corresponding with a shape of said light blocking device.

14. The system of claim 12, wherein said cap is slidably coupled to said front channel member of said light blocking device.

15. The system of claim 14, wherein said cap includes a projection extending downwardly from an inner surface of a top surface of said cap, said projection being sized and configured to be received within an opening formed in said front channel member.

16. The system of claim 14, wherein said cap includes a curved front edge forming a recess for coupling with a front edge of said front channel member for coupling said cap to said front channel member.

17. A perimeter light blockout system for minimizing an amount of light passing between gaps formed between a covering and a surface of a window frame or wall, said system comprising:

a mounting element configured to be mounted to the surface of the window frame or wall; and a light blocking device configured to be coupled to the mounting element;

wherein said light blocking device does not contact said covering;

wherein said light blocking device includes a rear channel member releasably coupled to a front channel member; said rear and front channel members each have an approximate L-shape so that when said front channel member is directly coupled to said rear channel member, said light blocking device has an approximate U-shaped channel for receiving the covering therein; and wherein said mounting element includes first and second arms for engaging one or more projections extending from said light blocking device.

18. The perimeter light blockout system of claim 17, wherein the light blocking device includes a U-shaped channel, the U-shaped channel having a channel depth D, wherein the channel depth D is greater than a depth of the covering so that spaces exist between interior surfaces of the light blocking device and the covering.

19. A perimeter light blackout system for minimizing an amount of iight passing between gaps formed between a covering and a surface of a window frame or wall, said system comprising:

a mounting element configured to be mounted to the surface of the window frame or wall; and a light blocking device configured to be coupled to the mounting element;

wherein said light blocking device includes a rear channel member releasably coupled to a front channel member, said rear and front channel members each have an approximate L-shape so that when said front channel member is directly coupled to said rear channel member, said light blocking device has an approximate U-shaped channel for receiving the covering therein; and wherein said mounting element includes first and second arms for engaging one or more projections extending from said light blocking device.

20. The perimeter light blockout system of claim 19, wherein said U-shaped channel has a channel depth D, said channel depth D is greater than a depth of the covering so that spaces exist between interior surfaces of said light blocking device and the covering.

21. The perimeter light blockout system of claim 19, wherein said mounting element provides a degree of adjustment relative to said light blocking device so that said light blocking device is aligned with an out-of-skew window frame.

* * * * *